US009259054B2

(12) United States Patent
Nishiwaki et al.

(10) Patent No.: US 9,259,054 B2
(45) Date of Patent: Feb. 16, 2016

(54) STRUCTURE FOR FRONT FOOT PORTION OF UPPER OF SHOE

(75) Inventors: Tsuyoshi Nishiwaki, Kobe (JP); Kouki Matsuo, Kobe (JP); Kenta Moriyasu, Kobe (JP); Seiji Yano, Kobe (JP); Rena Furuishi, Kobe (JP)

(73) Assignee: ASICS Corporation, Chuo-ku, Kobe (JP)

( * ) Notice: Subject to any disclaimer, the term of this patent is extended or adjusted under 35 U.S.C. 154(b) by 516 days.

(21) Appl. No.: 13/620,327

(22) Filed: Sep. 14, 2012

(65) Prior Publication Data

US 2013/0008053 A1 Jan. 10, 2013

Related U.S. Application Data

(63) Continuation-in-part of application No. PCT/JP2010/056875, filed on Apr. 16, 2010.

(51) Int. Cl.
*A43B 1/10* (2006.01)
*A43B 5/00* (2006.01)
(Continued)

(52) U.S. Cl.
CPC ..... *A43B 23/027* (2013.01); *A43B 23/0235* (2013.01); *A43B 23/0245* (2013.01); *A43B 23/0255* (2013.01); *A43B 23/0275* (2013.01); *A43B 23/081* (2013.01)

(58) Field of Classification Search
CPC ..... A43B 23/027; A43B 23/0235; A43B 23/0255; A43B 23/0275; A43B 23/0245; A43B 23/0281; A43C 1/00; A43C 1/003
USPC ..... 36/83, 102, 50.1, 3 A, 45
See application file for complete search history.

(56) References Cited

U.S. PATENT DOCUMENTS 4,080,745 A * 3/1978 Torrance ..... A32B 5/001 36/127
4,255,876 A * 3/1981 Johnson ..... A43B 5/00 36/129

(Continued)

FOREIGN PATENT DOCUMENTS

AT 376555 B 5/1984
EP 0016232 A1 10/1980

(Continued)

OTHER PUBLICATIONS

International Search Report, PCT/JP2010/056875, dated Jun. 29, 2010.

*Primary Examiner* — Clinton T Ostrup
*Assistant Examiner* — Cameron A Carter
(74) *Attorney, Agent, or Firm* — Mintz Levin Cohn Ferris Glovsky and Popeo, P.C.

(57) ABSTRACT

A low rigidity region being more stretchable and bendable than a high rigidity region, includes a main portion, and a medial first flexible portion and a lateral first flexible portion extending from the main portion in the medial and lateral directions. The main portion covers a portion of the area from the shaft of the first proximal phalanx to the shaft of the second proximal phalanx, the medial first flexible portion covers a portion of the area from the shaft of the first proximal phalanx to the head of the first metatarsal bone, and the lateral first flexible portion extends to the lateral side of the foot from the main portion. When pushing off the foot onto the medial/lateral side in a diagonally forward direction, the upper bends along the diagonal bend lines. Therefore, the diagonal portions and the main portion serve as the bend lines.

20 Claims, 18 Drawing Sheets

(51) Int. Cl.

| | |
|---|---|
| ***A43B 7/00*** | (2006.01) |
| ***A43C 11/00*** | (2006.01) |
| ***A43B 23/00*** | (2006.01) |
| ***A43B 23/02*** | (2006.01) |
| ***A43B 23/08*** | (2006.01) |

(56) References Cited

U.S. PATENT DOCUMENTS

| | | | | | |
|---|---|---|---|---|---|
| 4,562,652 | A * | 1/1986 | Hensler | A43B 5/0472 | 36/102 |
| 4,624,061 | A * | 11/1986 | Wezel | A43B 5/06 | 36/102 |
| 4,694,591 | A * | 9/1987 | Banich | A43B 5/00 | 36/102 |
| 5,430,959 | A * | 7/1995 | Mitsui | A43B 5/00 | 36/114 |
| 5,533,279 | A * | 7/1996 | Mitsui | A43B 5/00 | 36/45 |
| 5,692,320 | A * | 12/1997 | Nichols | A43C 1/04 | 36/170 |
| 5,765,296 | A * | 6/1998 | Ludemann | A43B 23/047 | 36/50.1 |
| D425,292 | S * | 5/2000 | Matis | D2/903 | |
| 6,195,914 | B1 * | 3/2001 | Otis | A43B 3/105 | 36/11.5 |
| D440,034 | S * | 4/2001 | Matis | D2/903 | |
| 6,444,074 | B1 * | 9/2002 | Marega | A43C 1/00 | 12/142 LC |
| D487,337 | S * | 3/2004 | Rogers | D2/969 | |
| 6,862,820 | B2 * | 3/2005 | Farys | A43B 1/0072 | 36/45 |
| 6,952,890 | B1 * | 10/2005 | Blakeslee | A43C 1/003 | 24/712 |
| D511,614 | S * | 11/2005 | Gerber | D2/972 | |
| 8,001,704 | B2 * | 8/2011 | Baudouin | A43B 7/1495 | 36/102 |
| 2002/0078597 | A1 * | 6/2002 | Burt | A43B 7/12 | 36/51 |
| 2004/0255486 | A1 * | 12/2004 | Pawlus | A43B 3/0047 | 36/10 |
| 2006/0162190 | A1 * | 7/2006 | Nishiwaki | A43B 5/10 | 36/97 |
| 2006/0185194 | A1 * | 8/2006 | Hubbard | A43B 5/00 | 36/83 |
| 2007/0180730 | A1 * | 8/2007 | Greene | A43B 9/00 | 36/3 A |
| 2008/0120871 | A1 * | 5/2008 | Sato | A43B 13/181 | 36/88 |
| 2009/0229144 | A1 * | 9/2009 | Sussman | A43B 3/24 | 36/97 |
| 2010/0269369 | A1 * | 10/2010 | Nishiwaki | A43B 23/047 | 36/28 |
| 2011/0113648 | A1 * | 5/2011 | Leick | A43B 1/0081 | 36/50.1 |
| 2011/0247238 | A1 * | 10/2011 | Chestnut | A43B 3/06 | 36/105 |

FOREIGN PATENT DOCUMENTS

| | | | | |
|---|---|---|---|---|
| EP | 2078468 | A1 * | 7/2009 | |
| EP | 2078468 | A1 | 7/2009 | |
| JP | 55-34472 | | 3/1980 | |
| JP | 60-180511 | A | 11/1985 | |
| JP | 62-109607 | U | 7/1987 | |
| JP | 1-26245 | | 8/1989 | |
| JP | 4-107608 | A | 9/1992 | |
| JP | 5-10649 | | 3/1993 | |
| JP | 6-49205 | Y2 | 12/1994 | |
| JP | 9-304 | | 1/1997 | |
| JP | 10-225302 | A | 8/1998 | |
| JP | 10-234408 | A | 9/1998 | |
| JP | 2000-93204 | A | 4/2000 | |
| WO | WO-2004/093587 | A1 | 11/2004 | |
| WO | WO 2004093587 | A1 * | 11/2004 | A43B 5/10 |
| WO | WO-2008/000398 | A1 | 1/2008 | |
| WO | WO-2008/047659 | A1 | 4/2008 | |

* cited by examiner

STRUCTURE FOR FRONT FOOT PORTION OF UPPER OF SHOE

CROSS-REFERENCE TO RELATED APPLICATIONS

This application is a continuation in part of the PCT international application No. PCT/JP2010/56875 filed on Apr. 16, 2010. The entire content of the international application is hereby incorporated herein by reference.

TECHNICAL FIELD

The present invention relates to an improved structure for a front foot portion of an upper of a shoe.

BACKGROUND ART

In on-court sports such as tennis, volleyball, and basketball, involving rapid movements forward, backward, left and right, a sport shoe needs to hold the front foot portion by an upper skin in order to prevent injuries in the foot portion. Therefore, the material of an upper skin is required to be non-stretchable and have a high strength. An upper skin is often reinforced with artificial leather, synthetic leather or a belt.

Such an upper skin has a high rigidity. Therefore, the upper skin less easily fits to the foot. For example, when raising the heel portion as is done frequently in such on-court sports as described above, when raising the heel and twisting the heel inwardly, and when raising the heel and twisting the heel outwardly, the front foot portion of the upper will have a large ruck, whereby the toe is easily compressed locally.

CITATION LIST

Patent Literature

[First Patent Document] Japanese Utility Model Publication for Opposition No. 6-49205

[Second Patent Document] Japanese Laid-Open Utility Model Publication No. 62-109607

[Third Patent Document] Japanese Laid-Open Utility Model Publication No. 5-10649

[Fourth Patent Document] Japanese Laid-Open Utility Model Publication No. 4-107608

[Fifth Patent Document] Japanese Laid-Open Patent Publication No. 9-304

[Sixth Patent Document] Japanese Laid-Open Patent Publication No. 10-225302

[Seventh Patent Document] WO2008-000398 (Japanese National Phase PCT Laid-Open Publication No. 2009-540976)

[Eighth Patent Document] AT4132/82 (Japanese Patent Publication for Opposition No. 62-033881)

[Ninth Patent Document] Japanese Utility Model Publication for Opposition No. 01-026245

[Tenth Patent Document] WO2008/047659A1

The first patent document discloses a toe reinforcement member in which a notch portion is formed in the bent portion position of the front treaded portion of the shoe.

The second patent document discloses an upper that easily bends and does not easily deform even with force applied thereto in the lateral direction, with the use of comb-shaped reinforcement sheets on the medial and lateral side opposing each other.

The third patent document discloses an upper with a generally cross-shaped notch portion formed in the toe portion of the upper, with a stretchable member sewn to the notch portion.

SUMMARY OF INVENTION

Technical Problem

However, with the techniques of the patent documents identified above, it will be difficult to realize both the holding of the front foot portion by the upper and a foot-fitting property (conformability) with little compressive feel when it is bent.

Thus, it is an object of the present invention to provide an improved structure for a front foot portion of an upper with which it is possible to obtain both the holding of the front foot portion and a foot-fitting property (conformability) with little compressive feel when it is bent.

Solution to Problem

FIG. 7 shows an example of an upper.

The present invention is a structure for a front foot portion of an upper U of a shoe having soles 51 and 52 supporting a foot sole and the upper U covering an instep, wherein: the front foot portion of the upper U includes a low rigidity region AL and a high rigidity region AH; and the low rigidity region AL covers a portion of tips of toes of a foot, and is more stretchable and bendable than the high rigidity region AH, the low rigidity region AL comprising: a main portion 10 extending in a front-back direction Y of the foot and in a transverse direction X perpendicular to the front-back direction in a middle between a medial side and a lateral side of the front foot portion, and including a portion of an area from a shaft of a first proximal phalanx B3$_1$ to a shaft of a second proximal phalanx B3$_2$; a medial first flexible portion 11 covering a portion of an area from the shaft of the first proximal phalanx B3$_1$ to a head of a first metatarsal bone B4$_1$, extending toward the medial side of the foot from the main portion 10 in the transverse direction X or in a diagonally posterior direction, and being continuous with the main portion 10; a lateral first flexible portion 21 covering a portion of an area from a shaft to a base of a third proximal phalanx B3$_3$ or a fourth proximal phalanx B3$_4$, extending toward the lateral side of the foot from the main portion 10 in the transverse direction X or in a diagonally posterior direction, and being continuous with the main portion 10; and at least one diagonal portion arranged anterior to the first flexible portions 11 and 21, extending from the main portion 10 in a diagonally anterior direction toward the lateral side or in a diagonally anterior direction toward the medial side, and being continuous with the main portion 10, wherein: the medial first flexible portion 11 and the lateral first flexible portion 21 are arranged along a straight line extending across the main portion 10 in the transverse direction X or along a forwardly-protruding curved line extending across the main portion 10; and the high rigidity region AH covers another portion of the tips of the toes around the main portion 10, and is less stretchable and bendable than the low rigidity region AL, the high rigidity region AH comprising: a peripheral portion 30 continuous with the soles 51 and 52, and covering a periphery around the tips of the toes on the medial side of the foot, on the lateral side of the foot, and in a tip of the foot; a medial posterior reinforcement portion 31 being in contact with a posterior edge of the medial first flexible portion 11, being continuous with the peripheral portion 30, and covering a portion of the head of the first metatarsal bone B4$_1$;

a medial anterior reinforcement portion 32 being in contact with an anterior edge of the medial first flexible portion 11, being continuous with the peripheral portion 30, extending from the peripheral portion 30 toward the main portion 10, and covering a portion of the shaft of the first proximal phalanx $B3_1$; a lateral posterior reinforcement portion 41 being in contact with a posterior edge of the lateral first flexible portion 21, and being continuous with the peripheral portion 30; a lateral anterior reinforcement portion 42 being in contact with an anterior edge of the lateral first flexible portion 21, being continuous with the peripheral portion 30, and extending from the peripheral portion 30 toward the main portion 10; and a portion provided on an anterior edge and a posterior edge of the diagonal portion and in contact with the anterior edge and the posterior edge of the diagonal portion.

Advantageous Effects of Invention

Before describing the advantageous effects of the present invention, the principles of the present invention will be described.

FIG. 8 is a side view showing the change in the shape of the foot F when pushing off in the forward direction Y1.

As shown in FIG. 8, when pushing off in the forward direction, the foot sole significantly bends at the metatarsal phalangeal joint (hereinafter referred to as the "MP joint").

In this process, the foot sole is in contact with the ground across the area of the heads of the first to third metatarsal bones and the tips of the toes anterior thereto, including the ball O1 of the big toe (first toe) posterior to the MP joint. On the other hand, the upper surface of the tips of the toes of the foot is bent in the vicinity of the MP joint which is anterior Y1 to the ball O1 of the big toe.

Thus, the bending position of the upper surface of the front foot portion of the foot is different from the bending position of the foot sole. On the other hand, it is not possible to avoid a difference between how the upper surface of the foot is bent and how the upper is bent. In view of this, we examined the relationship between the upper and the upper surface of the front foot portion of the foot when the foot is bent, by a procedure described below.

The results of examining the compressive feel to the foot from the upper when it is bent will be discussed using FIGS. 9A and 9B.

FIG. 9A is a plan view showing the measurement points S1 to S9 at which the contact pressure between the foot and the upper was measured, and FIG. 9B is a graph showing the pressures measured at the measurement points S1 to S9. The pressure was measured with the heel being raised by 130 mm wearing a tennis shoe available on the market.

As can be seen from FIGS. 9A and 9B, the pressure is large in the areas of the shaft of the first proximal phalanx $B3_1$, the shaft of the third proximal phalanx $B3_3$ and the head of the second metatarsal bone $B4_2$. Therefore, it is presumed that a foot-fitting property (conformability) with little compressive feel when it is bent is obtained if the pressure in these areas decreases.

According to the present invention, the low rigidity region AL, which is more stretchable and bendable than the high rigidity region AH, includes the main portion 10, and the medial first flexible portion 11 and the lateral first flexible portion 21 extending from the main portion 10 in the medial and lateral directions. The main portion 10 covers a portion of the area from the shaft of the first proximal phalanx $B3_1$ to the shaft of the second proximal phalanx $B3_2$, the medial first flexible portion 11 covers a portion of the area from the shaft of the first proximal phalanx $B3_1$ to the head of the first metatarsal bone $B4_1$, and the lateral first flexible portion 21 extends to the lateral side of the foot from the main portion 10.

Therefore, the medial first flexible portion 11 and the medial second flexible portion 12 are provided along the first bend line L1, along which the upper surface of the tips of the toes bends, or immediately anterior to the line L1.

On the other hand, the instep portion of the upper fastened by a shoe lace is it to the instep, and the tip of the toe is secured to the sole which is stepped upon by the toes. Therefore, it is preferred that the upper bends between the tip of the toe and the instep portion. Here, a flexible, band-shaped region extending in the lateral direction from the medial first flexible portion 11 to the lateral first flexible portion is arranged anterior to the ball O1 of the big toe of FIG. 8. Therefore, as the foot bends, the upper bends in the flexible band-shaped region, whereby the compression from the upper to the foot is small.

When pushing off the foot onto the lateral side in a diagonally forward direction, the foot will be "supinated" where the heel is raised and twisted toward the lateral side. (The medial side of the heel is urged to face the medial side.) In the case of this "supination", the foot bends along the MP joints $MP_2$ to $MP_5$ of the lateral-side toes, i.e., the second toe to the fifth toe, of FIG. 9A.

Therefore, the upper is likely to bend along the diagonal second bend line L2 anterior to $MP_3$ and $MP_4$ or in the vicinity of the line L2.

On the other hand, when pushing off the foot onto the medial side in a diagonally forward direction, the foot will be "pronated" where the heel is raised a rid twisted toward the medial side. (The lateral side of the heel is urged to face the lateral side.) In the case of this "pronation", a large load is applied upon the ball O1 of the big toe and the distal phalanx $B1_1$ of the first toe of FIG. 9A, and the balance is kept with the distal phalanges $B1_2$ and $B1_3$ of the second too and the third toe being in contact with the ground. Therefore, the upper is likely to bend along the significantly diagonal inclined third bend line L3 or in the vicinity of the line L3.

Thus, when pushing off the foot onto the medial/lateral side in a diagonally forward direction, the upper bends along the diagonal bend lines L2 and L3 or in the vicinity thereof. Therefore, the diagonal portions extending from the main portion 10 toward the lateral side or the medial side in a diagonally forward direction, and the main portion 10 serve as the bend lines L2 and L3.

Thus, there is little compressive feel transmitted from the upper to the foot.

Here, the medial first flexible portion 11 and the lateral first flexible portion 21 of FIG. 7 are arranged along a straight line extending across the main portion 10 in the transverse direction X or along a forwardly-protruding curved line. Therefore, the first flexible portion 11 or the first flexible portion 21 is arranged on a curved line continuous with the diagonal portion and easily conforms to the diagonal bend line.

On the other hand, the area around the tips of the toes is covered by the peripheral portion 30 having a high rigidity, and the areas anterior and posterior to the flexible portions are covered by the reinforcement portions. Therefore, it is unlikely that the function of holding the tips of the toes by the upper during rapid movements forward, backward, left and right in on-court sports is detracted from.

In the present invention, the high rigidity region being "less stretchable" than the low rigidity region means that the member forming the high rigidity region has a Young's modulus greater than that of the low rigidity region, whereby the sheet-like member is less stretchable in the high rigidity region than in the low rigidity region.

With the high rigidity of the member in the high rigidity region, the foot is supported by the upper on the medial and lateral side, thereby stabilizing the holding of the foot.

The low rigidity region being "more bendable" than the high rigidity region means that the sheet-like member forming the low rigidity region has a Young's modulus less than that of the high rigidity region, whereby the radius of curvature of the ruck occurring in the sheet-like member is smaller in the low rigidity region than in the high rigidity region.

Note that a base refers to a portion of each bone that is close to the posterior joint and that is slightly expanding to a greater thickness, and it is referred to also as a proximal head, whereas a head refers to a portion of each bone that is close to the anterior joint and that is slightly expanding to a greater thickness, and it is referred to also as a distal head. A shaft refers to a portion between the base and the head, and the thickness thereof typically changes smoothly.

DESCRIPTION OF EMBODIMENTS

Figure 1:
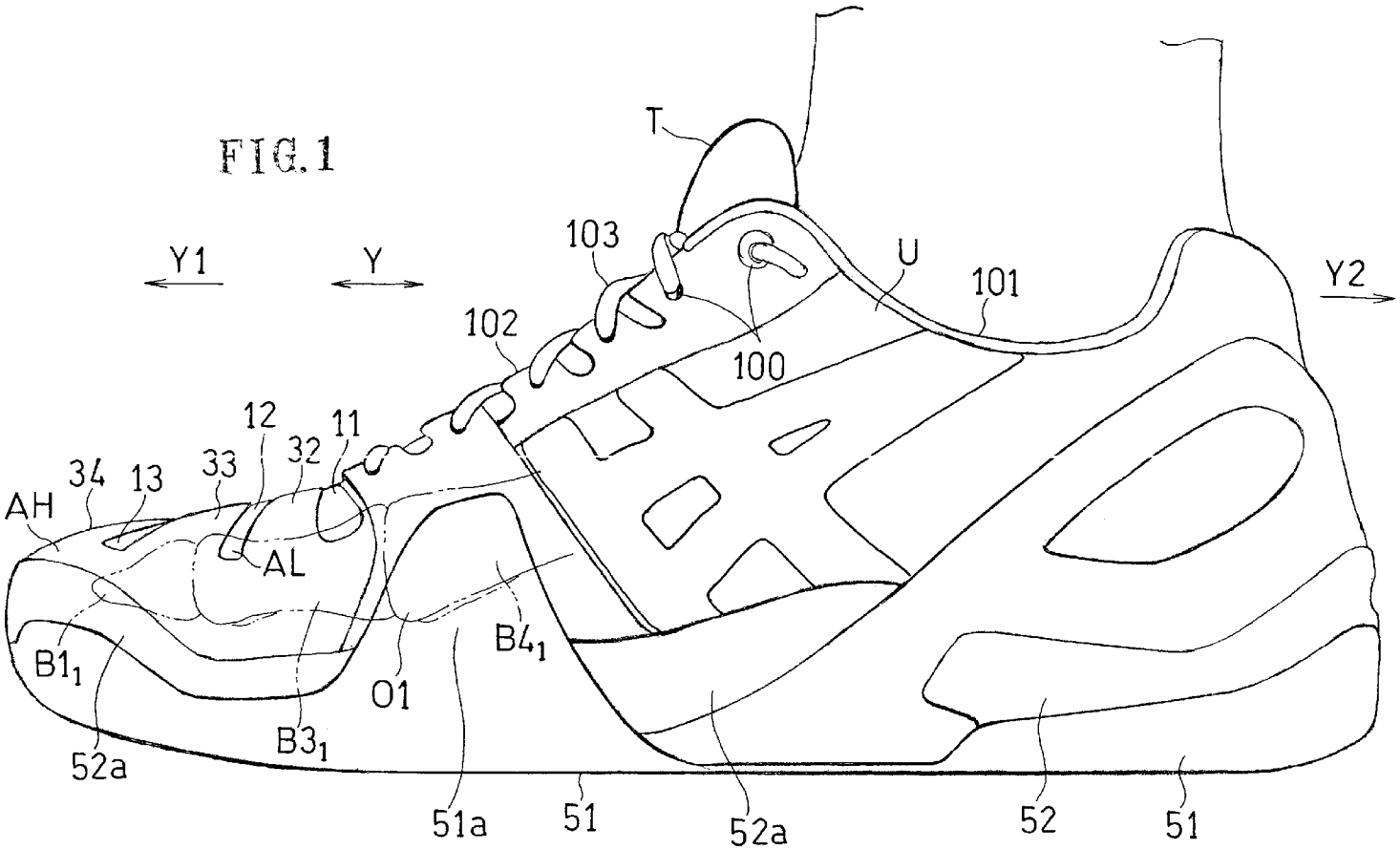
FIG. 1 is a medial side view showing a shoe of Example 1 of the present invention as viewed from the medial side.
Figure 2:
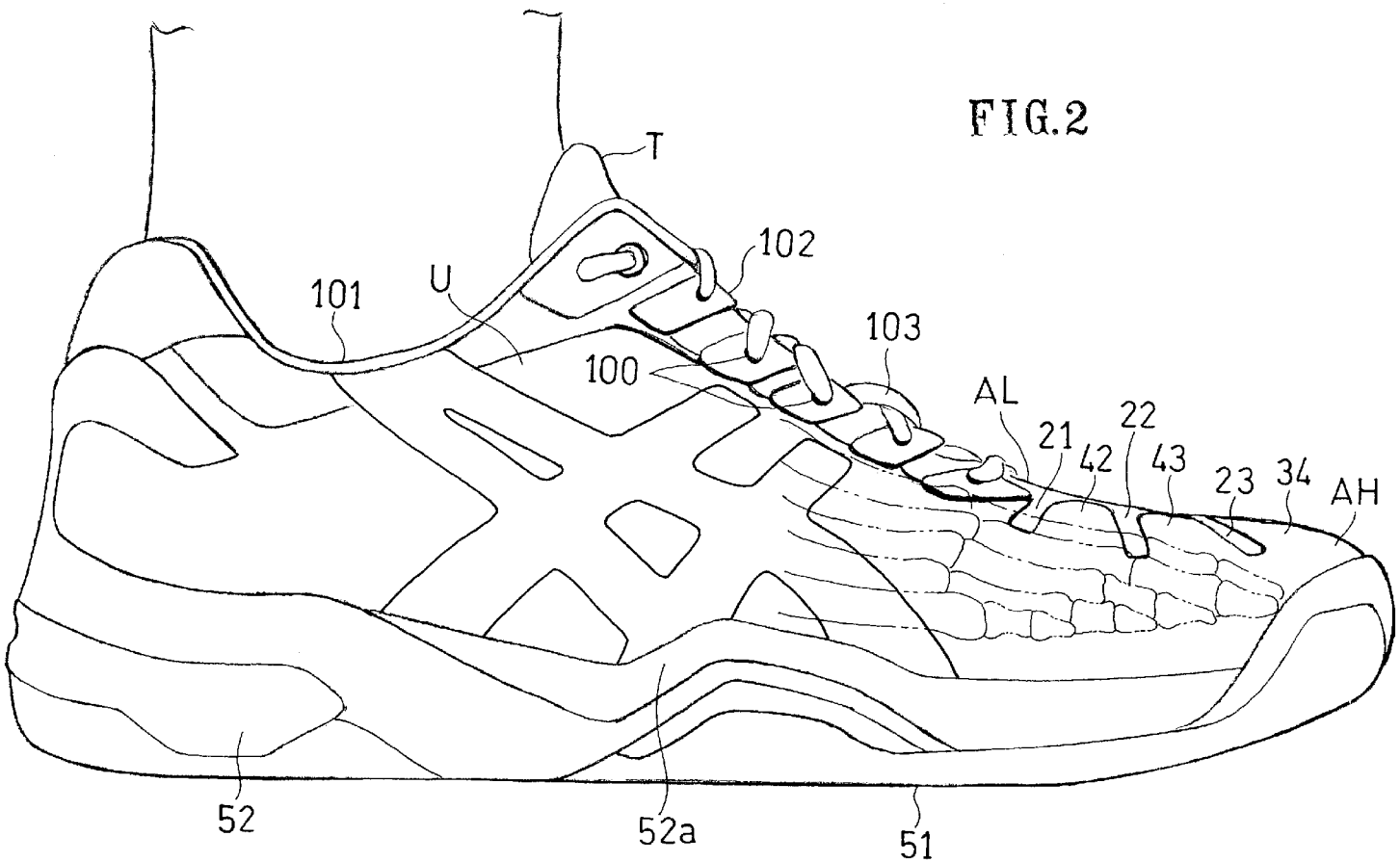
FIG. 2 is a lateral side view showing the shoe as viewed from the lateral side.

The present invention will be understood more clearly from the following description of preferred embodiments taken in conjunction with the accompanying drawings. Note however that the embodiments and the drawings are merely illustrative. The scope of the present invention shall be defined only by the appended claims. In the accompanying drawings, like reference numerals denote like components throughout the plurality of figures.

In a preferred example of the present invention, the medial first flexible portion 11 extends to a position more on the medial side than a ridgeline L10 of a big toe; and the diagonal portion is in contact with an anterior edge of the medial anterior reinforcement portion 32, and is extending to a position more on the medial side than the ridgeline L10 of the big toe in a diagonally forward direction on a medial side of the foot from the main portion 10 in an area posterior to a first interphalangeal joint $J_1$.

In the "supination" phase, the bending on the big toe side is greater than the bending on the little toe (fifth toe) side, whereby the bending of the upper on the big toe is also greater. On the other hand, in the "supination" phase, the foot tends to bend along the third and fourth MP joints $MP_3$ and $MP_4$.

For this, with the provision of the flexible diagonal portion 12 posterior to the first interphalangeal joint $J_1$ and on the anterior edge of the medial second reinforcement portion (medial anterior reinforcement portion) 32, in addition to the lateral first flexible portion 21, the upper bends easily in the vicinity of the second bend line L2. Therefore, the upper is more likely to conform to the foot in "supination".

Note that with the medial second reinforcement portion (medial anterior reinforcement portion) 32 covering the lateral side surface of the first proximal phalanx $B3_1$, the stability for holding the big toe is unlikely to be detracted from.

In another preferred example of the present invention, the medial first flexible portion 11 extends to a position more on the medial side than a ridgeline L10 of a big toe; and the diagonal portion extends from the main portion 10 in a diagonally forward direction on a lateral side of the foot into an area of a distal phalanx $B1_2$ of a second toe or a distal phalanx $B1_3$ of a third toe or an area between the distal phalanges $B1_2$ and $B1_3$ of the second toe and the third toe, in an area anterior to the lateral first flexible portion 21.

Figure 9A:
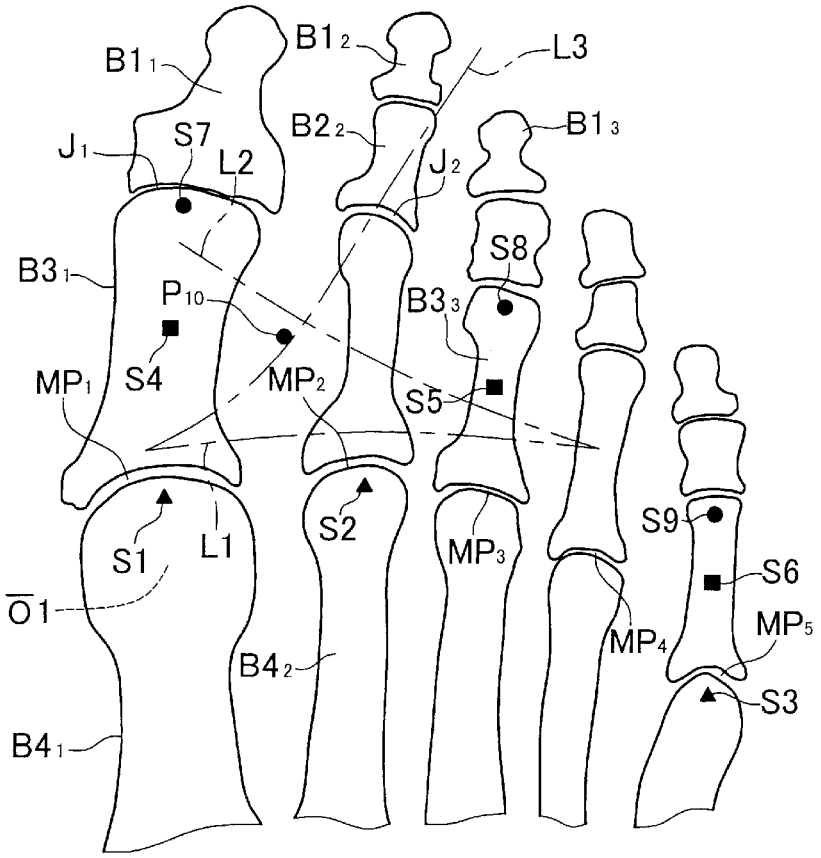
FIG. 9A is a plan view of the bone structure of the foot showing the measurement points.
Figure 9B:
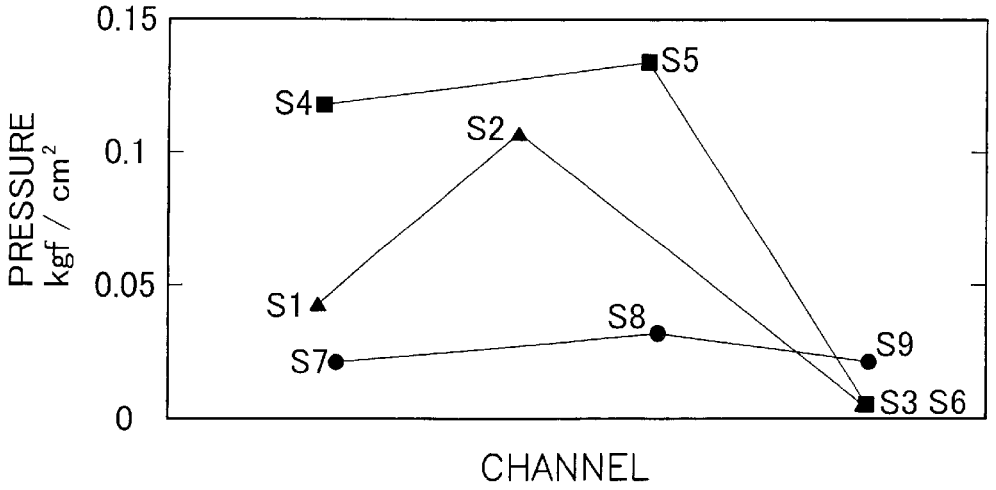
FIG. 9B is a graph showing the contact pressure at different measurement points.

In the "pronation" phase, the foot bends along the third bend line L3 in addition to the first bend line L1 of FIG. 9A.

For this, in addition to the medial first flexible portion 11, the diagonal portion 23 is extending to the distal phalanx $B1_2$ or $B1_3$ of the second toe or the third toe, whereby the upper bends easily in the vicinity of the greatly-inclined third bend line L3. Therefore, the upper is likely to conform to the foot in "pronation".

In a more preferred example of the present invention, the at least one diagonal portion is provided on the medial side and on the lateral side; the diagonal portion on the medial side is in contact with an anterior edge of the medial anterior reinforcement portion 32, and is extending from the main portion 10 in a diagonally forward direction on a medial side of the foot to a position more on the medial side than a ridgeline L10 of a big toe, in an area posterior to a first interphalangeal joint $J_1$; the diagonal portion on the lateral side extends from the main portion 10 in a diagonally forward direction on a lateral side of the foot into an area of a distal phalanx $B1_2$ of a second toe or a distal phalanx $B1_3$ of a third toe or an area between the distal phalanges $B1_2$ and $B1_3$ of the second toe and the third toe, in an area anterior to the lateral first flexible portion 21; and an angle $\alpha_{23}$ formed between a virtual line extending along a direction in which the diagonal portion on the lateral side extends and a virtual lateral line extending along the transverse direction X is greater than an angle $\alpha_{12}$ formed between a virtual line extending along a direction in which the diagonal portion on the medial side extends and the lateral line.

In this case, the upper is likely to conform to the foot both in "supination" and in "pronation".

In a preferred example of the present invention, a plurality of (some of) the at least one diagonal portions are provided on the lateral side; one of the plurality of diagonal portions is in contact with an anterior edge of the lateral anterior reinforcement portion 42, and forms a lateral second flexible portion 22 extending from the main portion 10 in a diagonally forward direction on a lateral side of the foot; another one of the plurality of diagonal portions forms a lateral third flexible portion 23 extending from the main portion 10 in a diagonally forward direction on a lateral side of the foot into an area of a distal phalanx $B1_2$ of a second toe or a distal phalanx $B1_3$ of a third toe or an area between the distal phalanges $B1_2$ and $B1_3$ of the second toe and the third toe, in an area anterior to the lateral second flexible portion 22; the lateral second flexible portion 22 and the lateral third flexible portion 23 are spaced apart from each other in a front-back direction with a portion of the high rigidity region AH interposed therebetween; and an angle $\alpha_{23}$ formed between a virtual line extending along a direction in which the lateral third flexible portion 23 extends and a virtual lateral line extending along the transverse direction X is greater than an angle $\alpha_{22}$ formed between a virtual line extending along a direction in which the lateral second flexible portion 22 extends and the lateral line.

When the foot bends significantly in the "pronation" phase, the upper bends significantly along the bend line L3 of FIG. 9A. Then, if there is only one diagonal portion on the lateral side, the significant bending of the upper may not be sufficiently absorbed only by the medial first flexible portion 11 and the single diagonal portion 23.

For this, with the two flexible portions 22 and 23, which are the diagonal portions, bending on the lateral side, the upper is likely to conform to the foot even in a phase with significant "pronation".

In such a case, in a more preferred embodiment, the at least one diagonal portion includes a diagonal portion provided on the medial side; the diagonal portion on the medial side forms a medial second flexible portion 12 being in contact with an anterior edge of the medial anterior reinforcement portion 32, and extending to a position, more on the medial side than a ridgeline L10 of a big toe in a diagonally forward direction on a medial side of the foot from the main portion 10 in an area posterior to a first interphalangeal joint $J_1$; and the angle $\alpha_{23}$ formed between a virtual line extending along a direction in which the lateral third flexible portion 23 extends and a virtual lateral line extending along the transverse direction X is greater than the angle $\alpha_{12}$ formed between a virtual line extending along a direction in which the medial second flexible portion 12 extends and the lateral line.

In a phase with significant "pronation", the medial side of the foot also bends significantly. Therefore, as in this example, the two medial flexible portions bend, in addition to the three flexible portions on the lateral side, whereby the upper is likely to conform to the foot even in the phase with significant "pronation".

The provision of three flexible portions on the lateral side and two flexible portions on the medial side not only improves the foot-fitting property of the upper during significant "pronation" and "supination", but also improves the foot-fitting property of the upper when the foot bends significantly in a forward direction.

In yet another preferred embodiment, a plurality of (some of) the at least one diagonal portions are provided on the medial side; one of the plurality of diagonal portions forms a medial second flexible portion 12 being in contact with an anterior edge of the medial anterior reinforcement portion 32, and extending from the main portion 10 in a diagonally forward direction on a medial side of the foot to a position more on the medial side than a ridgeline L10 of a big toe, in an area posterior to a first interphalangeal joint $J_1$; and another one of the plurality of diagonal portions forms a medial third flexible portion 13 extending from the main portion 10 in a diagonally forward direction on a medial side of the foot, in an area anterior to the medial second flexible portion 12.

When the foot bends significantly in the "supination" phase, the upper bends significantly along the bend line L2 (FIG. 9A) and a large load is applied upon the balls of the third toe and the fourth toe, whereby the upper is urged to bend also at the tip of the big toe.

For this, with the two flexible portions 12 and 13, which are the diagonal portions, bending, the upper is likely to conform to the foot even in a phase with significant "supination".

In another preferred example of the present invention, the main portion 10 extends in a forward direction or a diagonally forward direction from a head of a second metatarsal bone $B4_2$ to a shaft of a second proximal phalanx $B3_2$.

At the head of the second metatarsal bone, the contact pressure between the foot and the upper is reduced, and the upper is less likely to compress the foot.

In another preferred example of the present invention, the upper includes a tongue covering the instep, and the main portion 10 is continuous with the tongue, with a width of the main portion 10 in the transverse direction X decreasing gradually in a forward direction.

Where the main portion 10 is continuous with the tongue, the head of the second metatarsal bone can be easily covered with the low rigidity region AL. Where the width of the main portion 10 decreases gradually toward the tip of the upper, it is easier to ensure the function of holding the foot by the peripheral portion 30 of the upper.

In a preferred example of the present invention, the peripheral portion 30 of the high rigidity region AH covers a medial side surface of a big toe in an area more on the medial side than the medial first flexible portion 11; and the peripheral portion 30 of the high rigidity region AH covers a lateral side surface of a little toe in an area more on the lateral side than the lateral first flexible portion 21.

In this case, it is easier to ensure the function of holding the big toe and the little toe by the side surface of the upper.

In a preferred example of the present invention, the lateral first flexible portion 21 extends from the main portion 10 to a position more on the lateral side than a lateral edge of the third proximal phalanx $B3_3$.

In this case, the upper bends easily along the bend line L1.

In another preferred example of the present invention, the medial and lateral first flexible portions 11 and 21 have lengths in the transverse direction X greater than widths thereof in the front back direction Y.

In this case, each flexible portion has a longer length along the first bend line L1 (FIG. 9A).

In another preferred example of the present invention, typically, the low rigidity region AL is formed by a sheet-like first member which forms the upper; and the high rigidity region AH is formed by the first member, and a second member which is layered on a surface of the first member and is less stretchable than the first member.

For example, a mesh fabric, a knitted fabric, a woven fabric, a non-woven fabric, a synthetic leather, a natural leather, etc., may be appropriately used as the first member. For example, a resin, a rubber, a fiber material, or the like, may be bonded, attached, sewn, applied or otherwise put onto the first member, and appropriately used as the second member. The first member and the second member may be layered together by being bonded or sewn together, but they may be connected together by being bonded, attached, sewn, or otherwise put onto each other, while partially overlapping with each other, instead of layering them together.

Note that the materials of the parts of the upper may be appropriately used within such a range that does not essentially inhibit the functions and advantageous effects of the present invention.

In this case, in a preferred embodiment, the second member includes a medial side edge portion 301 covering a medial side surface of a big toe, a lateral side edge portion 302 covering a lateral side surface of a little toe, and a plurality of protruding portions (convex portions) protruding from the medial side edge portion 301 or the lateral side edge portion 302 toward the main portion 10 and being spaced apart from one another in the front-back direction Y; and the second member defines a depressed portion (concave portion) forming the diagonal portion between the plurality of protruding portions.

In the case of this example, it is more preferred that the second member includes a bank-like (mound-like) ridge portion extending from the medial and lateral side edge portions 301 and 302 to the protruding portions; and the ridge portion 65 extends along an edge of the protruding portions.

In this case, the tensile rigidity of the protruding portions and the bending rigidity thereof when the upper is bent are increased by the ridge portion.

In a preferred example of the present invention, the first member is formed by an air-permeable mesh-like member; and the second member is formed by a synthetic resin having a plurality of through holes allowing passage of air therethrough.

The upper will be suitably bendable also in the high rigidity region AH while ensuring air-permeability also in the area of the high rigidity region AH.

In a preferred example of the present invention, the flexible portions 11 and 21 and the diagonal portion each have a width in a width direction perpendicular to a direction in which the flexible portion or the diagonal portion extends, with the width increasing gradually toward the main portion 10.

In this case, flexible portions and diagonal portions that are elongated along bend lines are likely to be formed while it is possible to ensure wide widths of reinforcement portions in the vicinity of the peripheral portion 30.

In a preferred example of the present invention, each of the protruding portions (convex portions) has a width in a width direction perpendicular to a direction in which the protruding portion extends, with the width of the protruding portion decreasing gradually toward the main portion 10; and the depressed portion has a width in a width direction perpendicular to a direction in which the depressed portion extends, with the width of the depressed portion increasing gradually toward the main portion 10.

In this case, the depressed portion on the medial side and the depressed portion on the lateral side are likely to be smoothly continuous with each other along a virtual line via the main portion 10, whereby the upper bends easily along each bend line.

In a preferred example of the present invention, posterior edges of the medial and lateral first flexible portions 11 and 21 each extend in a diagonally backward direction.

The medial or lateral first flexible portions 11 or 12, which extends in a diagonally backward direction, will likely be smoothly continuous with a diagonal portion extending in a diagonally forward direction via the main portion 10.

In a preferred example of the present invention, the medial first flexible portion 11 extends to a position more on the medial side than a ridgeline L10 of a big toe.

In this case, the upper bends easily in the medial first flexible portion 11.

EXAMPLES

Examples of the present invention will now be described with reference to the drawings.

Example 1

FIGS. 1 to 7 show a shoe (for right foot) of Example 1.

In the following examples, IN denotes the medial side of the foot, and OUT denotes the lateral side of the foot.

As shown in FIG. 1, the shoe of this example includes soles 51 and 52 for absorbing the shock upon landing, and the upper U for wrapping around the instep. The soles are for supporting the foot sole, and include the outer sole 51 and the mid sole 52. As shown in FIG. 1, the upper U is provided with a plurality of insertion holes 100 such as eyelet holes.

The upper U fits to the instep by fastening a shoe lace 103 (an example of the fastening member) passed through these insertion holes 100.

As shown in FIG. 1, the upper U includes a first opening 101 through which a leg comes out in an upward direction when worn, and a second opening 102 located anterior Y1 to the first opening 101 and is closed by the tongue T. The first and second openings 101 and 102 are continuous with each other in the front-back direction Y. The tongue T covers the instep.

Figure 6A:
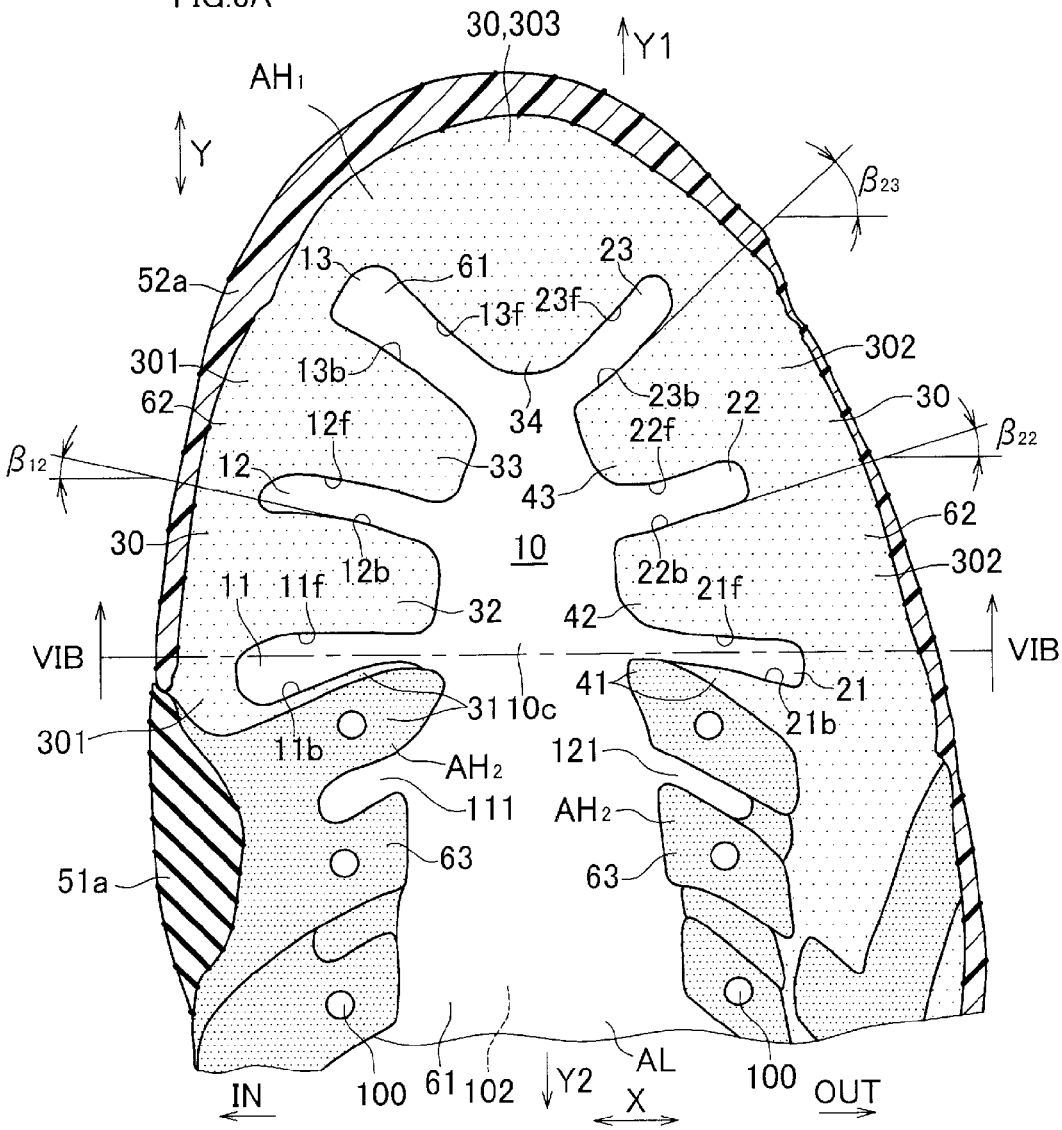
FIG. 6A is a plan view of the front foot portion for illustrating the materials of the sole and the upper.

FIG. 6A shows the materials of the upper and the soles.

In FIG. 6A, a roll-up portion 51*a* denoted by hatching is formed by substantially rolling up the outer sole 51 (FIG. 1) made of a rubber, and supports the medial side of the foot. A roll-up portion 52*a* denoted by different hatching than the aforementioned hatching is formed by rolling up the mid sole 52 (FIG. 1) made of a foamed resin, and supports the periphery of the foot.

The front foot portion of the upper includes the low rigidity region AL, and the first and second high rigidity regions $AH_1$ and $AH_2$. The low rigidity region AL is neither dotted nor hatched. On the other hand, the high rigidity regions $AH_t$ are each dotted or hatched, and the second high rigidity region $AH_2$, which has the higher rigidity of the high rigidity regions $AH_i$, is dotted with a higher density.

The low rigidity region AL covers a portion of the tips of the toes of the foot, and is more stretchable and bendable than the high rigidity region $AH_i$. The high rigidity region $AH_i$ covers another portion of the tips of the toes around the low rigidity region AL, and is less stretchable and bendable than the low rigidity region AL. Therefore, when the foot bends and the upper bends, a ruck occurs in the upper in the low rigidity region AL, thereby slackening the material of the upper.

Note that the high rigidity region $AH_1$ will also have a ruck, whose curvature is less than that of the ruck occurring in the low rigidity region AL.

Figure 6B:
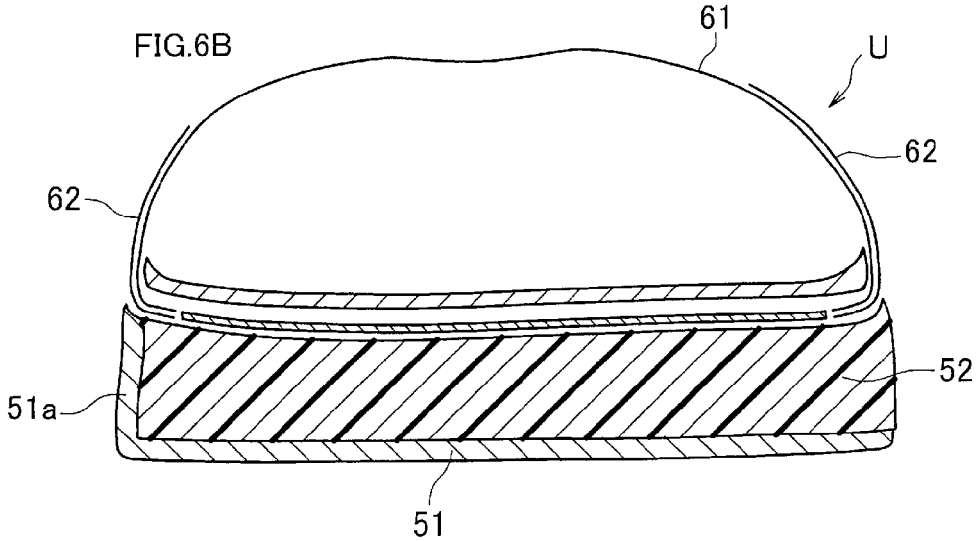
FIG. 6B is a cross-sectional view of the shoe taken along line VIB-VIB.

As shown in FIG. 6B, the low rigidity region AL is formed by a flexible sheet-like first member 61, which forms the upper U.

The first high rigidity region $AH_1$ of FIG. 6A is formed by the first member 61, and a second member 62 that is layered on the surface of the first member 61 of FIG. 6B and is less stretchable than the first member 61. The second high rigidity region $AH_2$ is formed by further welding or sewing non-stretchable third member 63 onto the first and second members 61 and 62 forming the first high rigidity region $AH_1$.

Note that in FIG. 6B and FIG. 14B to be discussed later, the first to third members 61 to 63 are shown diagramatically for the sake of simplicity.

Figure 3A:
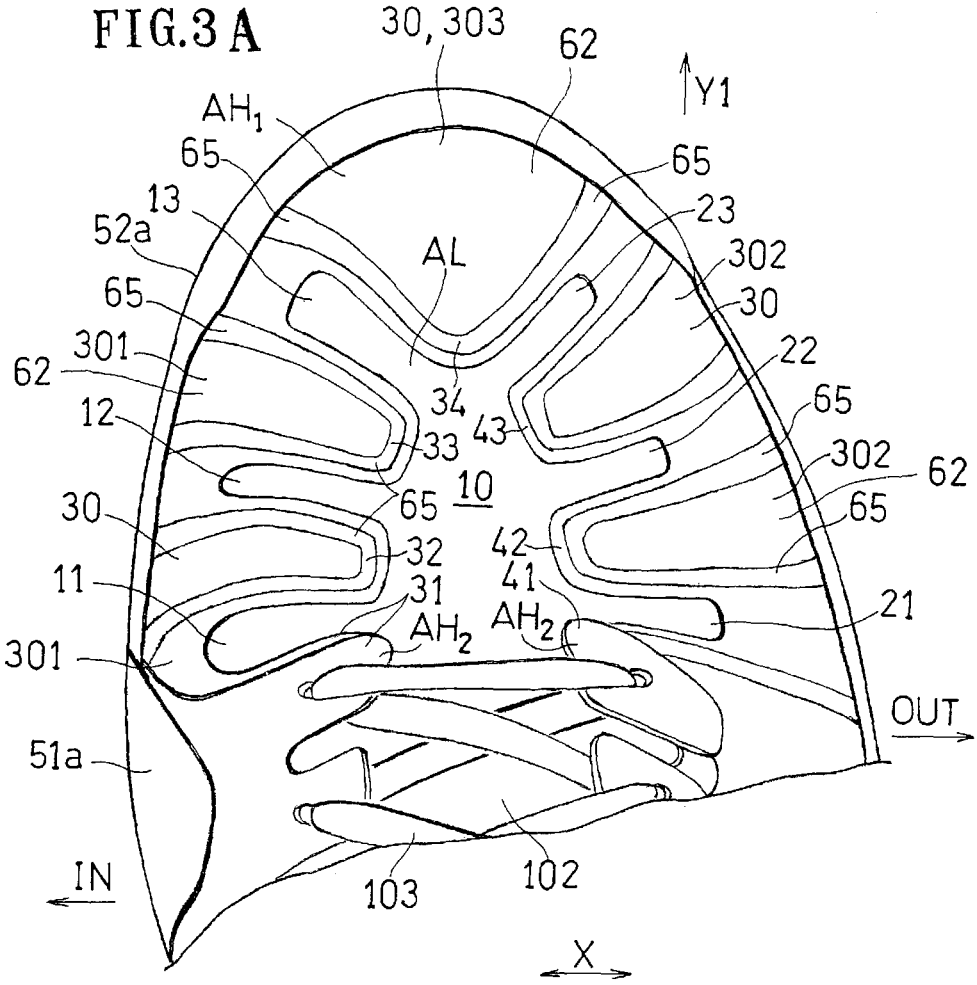
FIG. 3A is a plan view showing a front foot portion of the shoe as viewed from above.
Figure 3B:
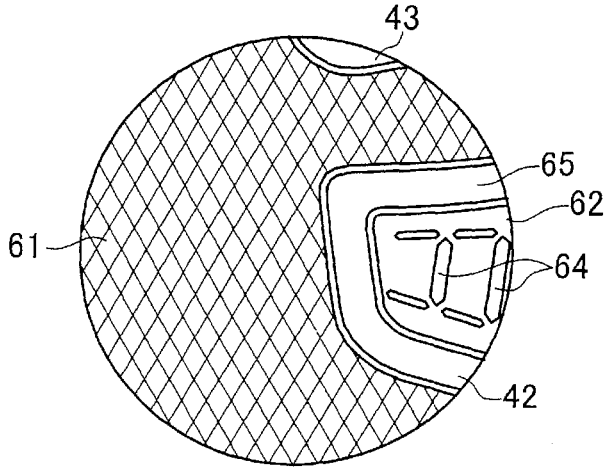
FIG. 3B is a partial enlarged view of an upper of the shoe.

As shown in FIG. 3B, the first member 61 is formed by an air-permeable mesh-like member, and the second member 62 is formed by a synthetic resin including a plurality of through holes 64 that allow for the passage of the air. The second member 62 of the synthetic resin may be formed integral with the first member 61.

The third member 63 may be a synthetic leather, a resin, a tape material, or the like, that is typically used to form eyelets (or form ornamental eyelets).

Note that the roll-up portion 51*a* made of a rubber covers a portion of the surface of the third member 63, forms a portion of the high rigidity region $AH_2$, and has the highest rigidity.

Figure 7:
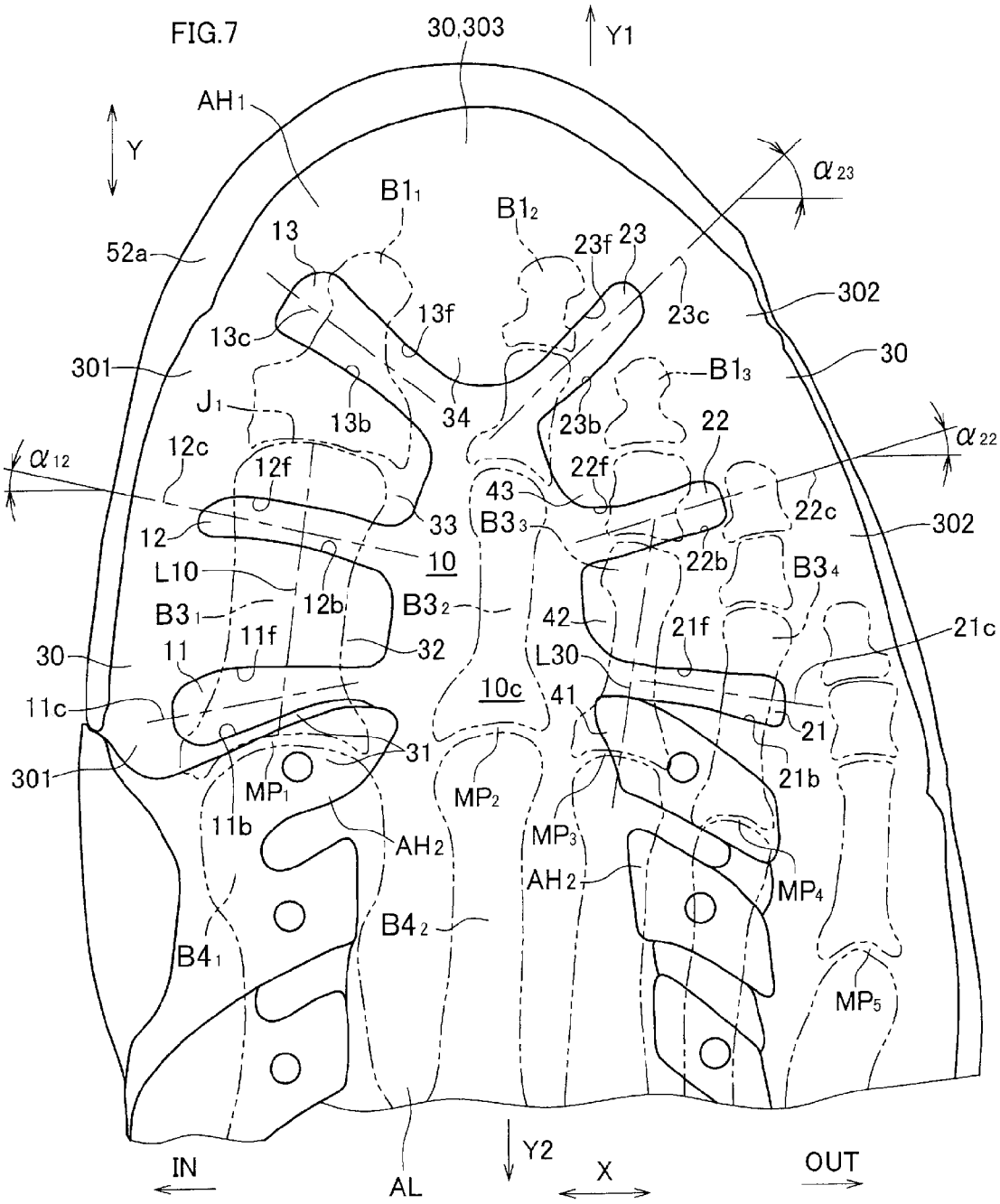
FIG. 7 is a plan view of the front foot portion showing the relationship between the low rigidity region, the high rigidity region, and the bone structure of the foot.
Figure 8:
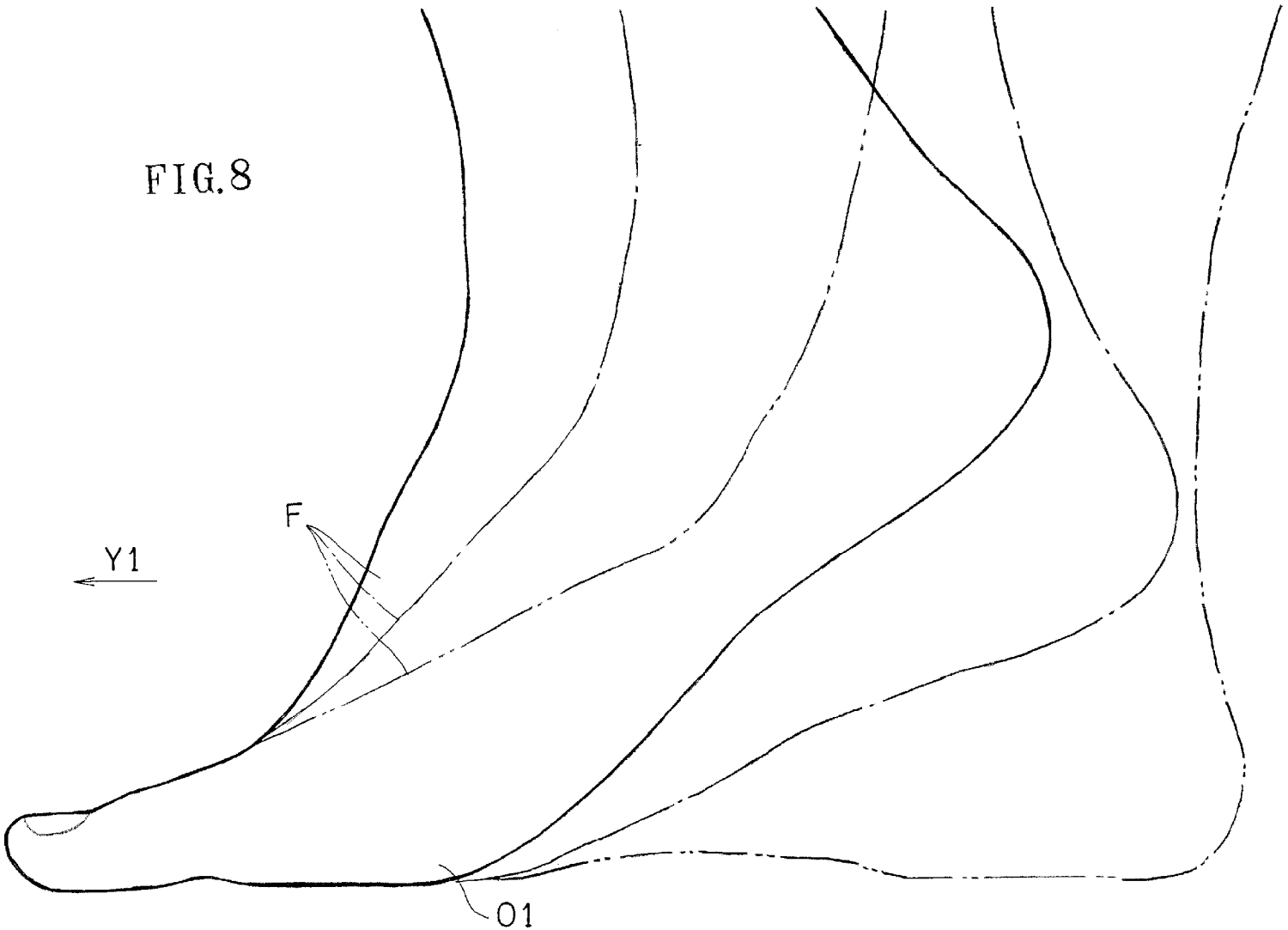
FIG. 8 is a medial side view showing the foot as viewed from the medial side, illustrating how the foot is bent.

In FIG. 7, the low rigidity region AL includes the main portion 10, a plurality of medial first to third flexible portions 11 to 13, and the lateral first to third flexible portions 21 to 23. The main portion 10 extends in the front-back direction Y and in the transverse direction X perpendicular to the front-back direction Y in the middle between the medial side and the lateral side of the front foot portion, and includes a portion of the area from the shaft of the first proximal phalanx $B3_1$ to the shaft of the second proximal phalanx $B3_2$.

It is preferred that the main portion 10 includes a core region 10*c* to be described below.

The upper is desirably flexible along three bend lines L1 to L3 of FIG. 9A and at the measurement point S2 at which the contact pressure is high. Therefore, the core region 10*c* preferably includes the intersection $P_{10}$ and the head of the second metatarsal bone $B4_2$, wherein the intersection $P_{10}$ is an intersection between a straight line (not shown) connecting between the first interphalangeal joint $J_1$ and the second MP joint $MP_2$, and a straight line (not shown) connecting between the second interphalangeal joint $J_2$ and the first MP joint $MP_1$.

That is, the core region 10*c* preferably includes the center point $P_{10}$ (FIG. 9A) between the shaft of the first proximal phalanx $B3_1$ and the shaft of the second proximal phalanx $B3_2$, and the head of the second metatarsal hone $B4_2$. As such a core region 10*c* is included by the main portion 10, the main portion 10 will contribute to the ease of bending of the upper in all phases including bending forward, "supination" and "pronation".

The medial first flexible portion 11 of FIG. 7 covers a portion of an area from the shaft of the first proximal phalanx $B3_1$ and the head of the first metatarsal bone $B4_1$, extends generally along the transverse direction X from the main portion 10 toward a position more on the medial side IN of the foot than directly above the first proximal phalanx $B3_1$, and is continuous with the main portion 10. On the other hand, the lateral first flexible portion 21 extends generally along the transverse direction X from the main portion 10 toward the lateral side OUT of the foot, and is continuous with the main portion 10.

Note that the notch portions 111 and 121 each extending in a diagonally backward direction are formed in ornamental eyelets which are formed by the third member 63 of FIG. 6A. These notch portions 111 and 121 are continuous with the second opening 102, making the third member 63 more bendable.

Figure 14A:
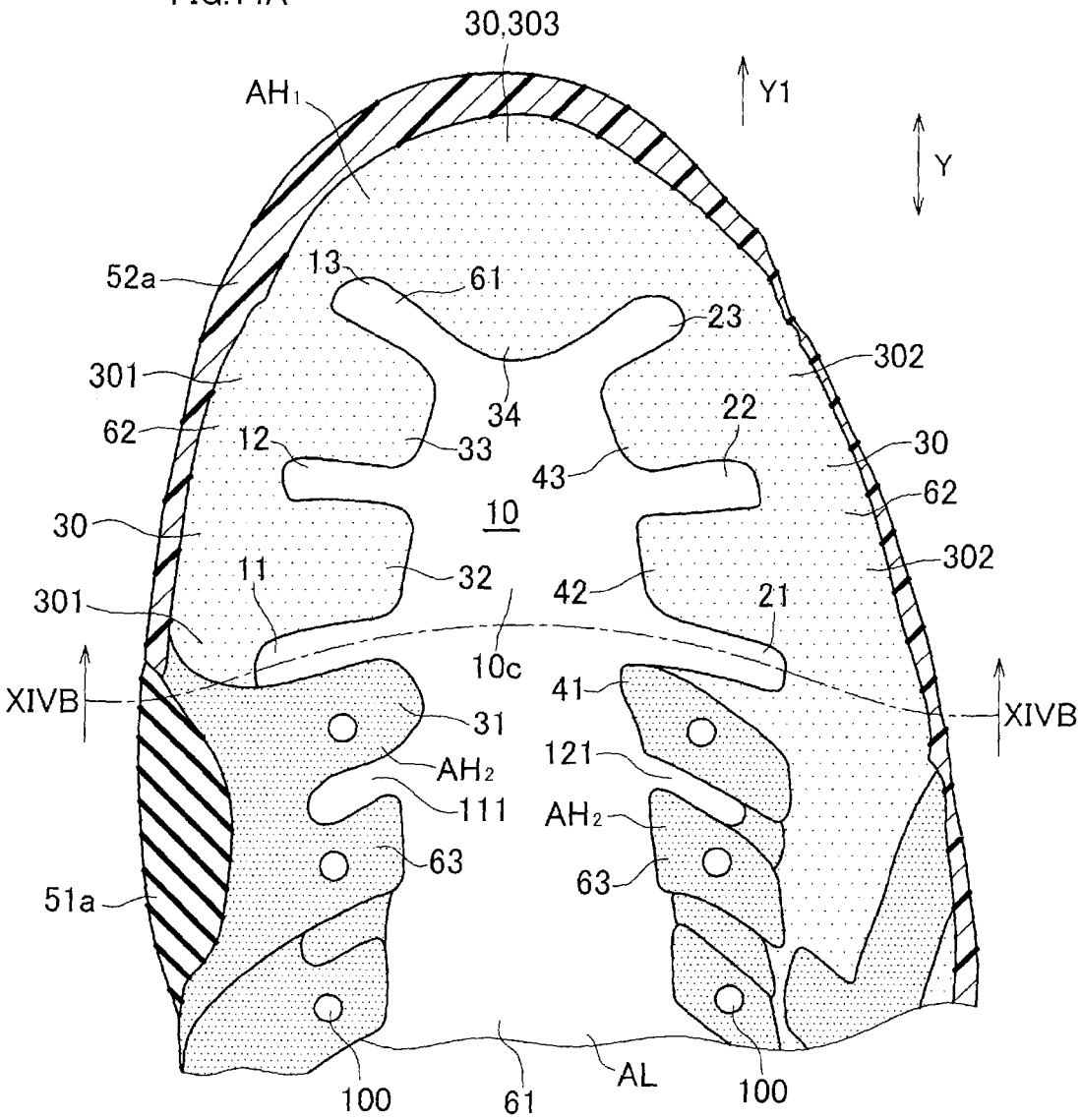
FIG. 14A is a plan view showing the front foot portion of a shoe of Example 10 of the present invention.
Figure 14B:
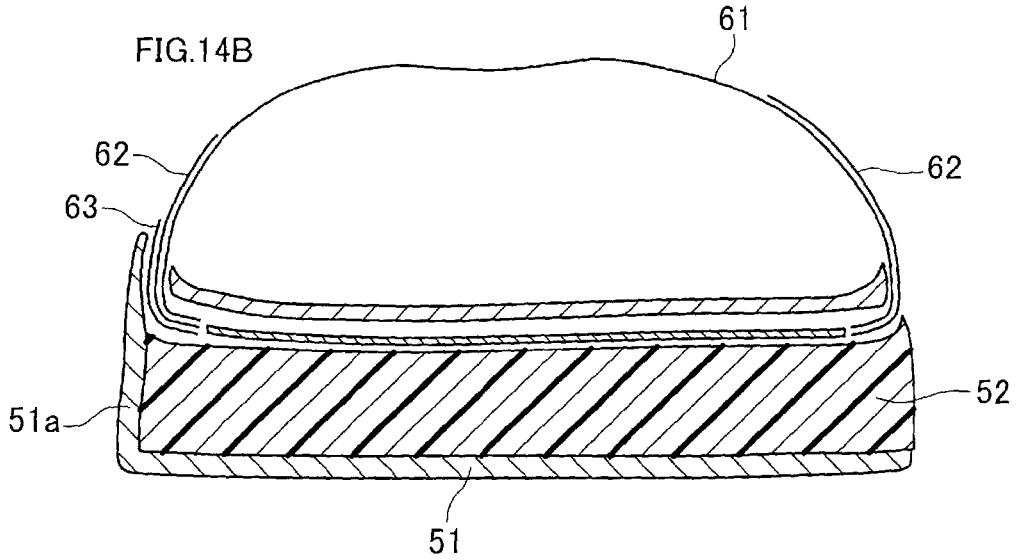
FIG. 14B is a cross-sectional view of the shoe taken along line XIVB-XIVB.

The medial first flexible portion 11 and the lateral first flexible portion 21 are arranged along a virtual straight line represented by the cross-sectional line VIB-VIB of FIG. 6A, which is extending in the transverse direction X across the core region 10*c* of the main portion 10, or along a virtual curved line represented by the cross-sectional line XIVB-XIVB, which is extending in the transverse direction X across the core region 10*c* of the main portion 10 of FIG. 14A and protruding toward the forward direction Y1. That is, the medial and lateral first flexible portions 11 and 12 are arranged at generally the same position in the front-back direction Y, and are opposing each other in the transverse direction X with the core region 10*c* interposed therebetween.

The virtual curved line may be a line including a curved line and a straight line smoothly continuous with each other.

The medial second flexible portion 12 and the medial third flexible portion 13 are arranged anterior Y1 to the first flexible portions 11 and 21, forming diagonal portions extending from the main portion 10 toward the medial side IN in a diagonally forward direction and being continuous with the main portion 10.

The lateral second flexible portion 22 and the lateral third flexible portion 23 are arranged anterior Y1 to the first flexible portions 11 and 21, forming diagonal portions extending from the main portion 10 toward the lateral side OUT in a diagonally forward direction and being continuous with the main portion 10.

In this example of FIG. 6A, the flexible portions 11 to 13 and 21 to 23 are arranged anterior Y1 to the anterior edge of the eyelet member 63 which is the third member.

At the anterior edge thereof, the eyelet member 63 is split into medial and lateral portions which are not continuous with each other.

The first and second high rigidity regions $AH_1$ and $AH_2$ are in contact with the low rigidity region AL.

The first high rigidity region $AH_1$ includes a peripheral portion 30, and includes a first medial reinforcement portion 31 to a third medial reinforcement portion 33, a tip reinforcement portion 34, and a first lateral reinforcement portion 41 to a third lateral reinforcement portion 43, which are continuous with the peripheral portion 30.

The peripheral portion 30 includes a medial side edge portion 301, a lateral side edge portion 302 and a tip edge portion 303, which are continuous with the soles 51 and 52 and cover the periphery of the tips of the toes on the medial side of the front foot portion, on the lateral side thereof and in the tip thereof.

In the case of this example, the tip edge portion 303 is continuous with the medial side edge portion 301 and the lateral side edge portion 302.

In FIG. 7, the medial first reinforcement portion (medial posterior reinforcement portion) 31 is in contact with a posterior edge 11*b* of the medial first flexible portion 11, and is continuous with the medial side edge portion 301. The medial first reinforcement portion 31 covers a portion of the head of the first metatarsal bone $B4_1$.

The medial second reinforcement portion (medial anterior reinforcement portion) 32 is in contact with an anterior edge 11*f* of the medial first flexible portion 11 and the posterior edge 11*b* of the medial second flexible portion 12, is continuous with the peripheral portion 30, and is extending from the medial side edge portion 301 toward the main portion 10. The medial second reinforcement portion 32 covers a portion of the shaft of the first proximal phalanx $B3_1$.

The medial third reinforcement portion (an example of a portion in contact with a diagonal portion) 33 is in contact with an anterior edge 12*f* of the medial second flexible portion 12 and a posterior edge 13*b* of the medial third flexible portion 13, is continuous with the medial side edge portion 301, and extends in a diagonally backward direction from the medial side edge portion 301 toward the main portion 10. The medial third reinforcement portion 33 covers the upper surface of the first interphalangeal joint $J_1$.

The tip reinforcement portion 34 is in contact with an anterior edge 13*f* of the medial third flexible portion 13 and an anterior edge 23*f* of the lateral third flexible portion 23, and is continuous with the tip edge portion 303 of the peripheral portion 30. It is preferred that the tip reinforcement, portion 34 extends in the backward direction Y2 from the tip edge portion 303 toward the main portion 10, and covers from above a portion of the distal phalanx $B1_1$ of the first toe or the distal phalanx $B1_2$ of the second toe, or a portion of an area between these distal phalanges $B1_1$ and $B1_2$.

In FIG. 7, the lateral first reinforcement portion (lateral posterior reinforcement portion) 41 is in contact with a posterior edge 21*b* of the lateral first flexible portion 21, and is continuous with the lateral side edge portion 302. The lateral first reinforcement portion 41 covers a portion or whole of the upper surface of the bases of the third and fourth proximal phalanges $B3_3$ and $B3_4$.

The lateral second reinforcement portion (lateral anterior reinforcement portion) 42 is in contact with an anterior edge 21*f* the lateral first flexible portion 21 and a posterior edge 22*b* of the lateral second flexible portion 22, and is continuous with the lateral side edge portion 302. It is preferred that the lateral second reinforcement portion 42 extends from the lateral side edge portion 302 toward the main portion 10, and covers a portion or whole of the upper surface of the head of the third or fourth proximal phalanx $B3_3$ or $B3_4$.

The lateral third reinforcement portion (an example of a portion in contact with a diagonal portion) 43 is in contact with an anterior edge 22*f* of the lateral second flexible portion 22 and a posterior edge 23*b* of the lateral third flexible portion 23, and is continuous with the lateral side edge portion 302. The lateral third reinforcement portion 43 extends in a diagonally backward direction from the lateral side edge portion 302 toward the main portion 10, and covers a portion or whole of the upper surface of the third distal phalanx $B1_3$.

The second member 62 of FIG. 6B includes the medial side edge portion 301 covering the medial side surface of the big toe of FIG. 7, the lateral side edge portion 302 covering the lateral side surface of the little toe, the tip edge portion 303 covering the front surface of the tips of the big toe and the little toe, and a plurality of protruding portions (convex portions), which are continuous together. The protruding portions form the reinforcement portions 31 to 34 and 41 to 43, and are protruding toward the main portion 10 from the medial side edge portion 301, the tip edge portion 303 or the lateral side edge portion 302.

The second member 62 defines depressed portions (concave portions) forming the flexible portions 11 to 13 and 21 to 23 between the plurality of protruding portions.

In FIG. 3A, the second member 62 includes a bank-like (mound-like) ridge portion 65 extending from the medial and lateral edge portions 301 and 302 to the protruding portions. The ridge portion 65 extends along the edge of the protruding portions.

In FIG. 7, the medial second flexible portion 12 is in contact with the anterior edge of the medial second reinforcement portion 32, and is extending from the main portion 10 in a diagonally forward direction on the medial side of the foot to a position more on the medial side IN than the ridgeline L10 of the big toe, in an area posterior Y2 to the first interphalangeal joint $J_1$.

The direction in which the lateral third flexible portion 23 extends is more inclined with respect to the transverse direction X than the direction in which the medial second flexible portion 12 extends.

The lateral second flexible portion 22 is in contact with the anterior edge of the lateral second reinforcement portion 42 and the posterior edge of the lateral third reinforcement portion 43, and is extending from the main portion 10 in a diagonally forward direction on the lateral side of the foot, in an area posterior to the tip of the third toe.

The lateral third flexible portion 23 extends from the main portion 10 in a diagonally forward direction on the lateral side of the foot to the distal phalanx $B1_2$ of the second toe or the distal phalanx $B1_3$ of the third toe, or to a position therebetween, in an area anterior to the lateral second flexible portion 22.

The lateral second flexible portion 22 and the lateral third flexible portion 23 are spaced apart from each other in the front-back direction with the lateral third reinforcement portion 43 interposed therebetween. The direction in which the lateral third flexible portion 23 extends is more inclined with respect to the transverse direction X than the direction in which the lateral second flexible portion 22 extends.

Next, how the upper U deforms when a shoe of this example 1 is worn on a foot and the foot is dorsiflexed will be described.

Figure 4A:
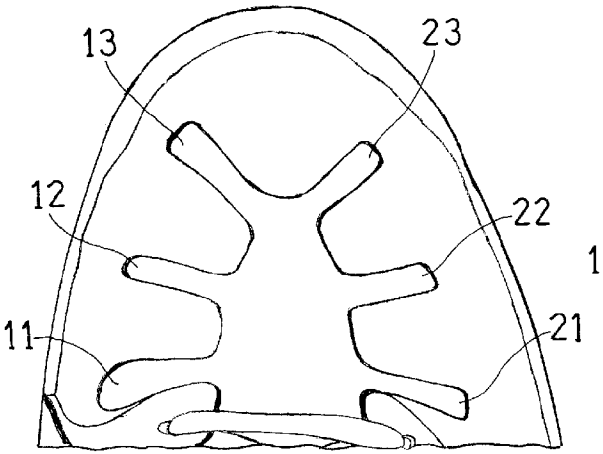
FIGS. 4A, 4B and 4C are plan views showing the deformation of the front foot portion of the upper before the foot is bent and after the foot is bent.
Figure 4B:
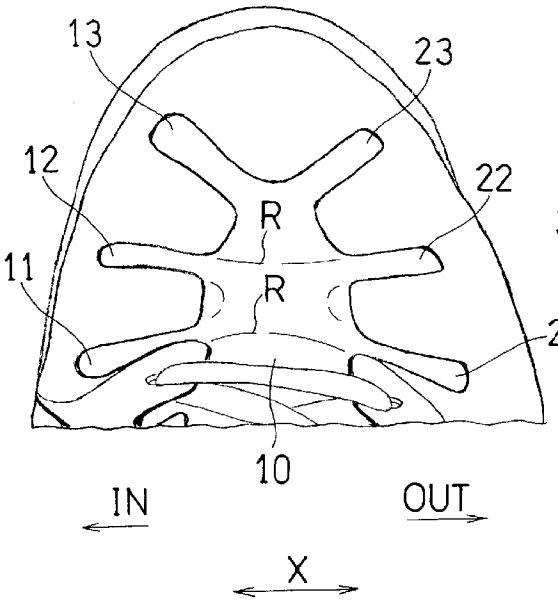

FIG. 4A shows a state of the upper U in a standing position. As the heel was raised from this state to dorsiflex the foot, creases (rucks) occurred in the medial first and second flexible portions 11 and, 12 on the medial side of the foot as shown in FIG. 4B, thereby shrinking the medial first and second flexible portions 11 and 12 in the front-back direction, whereas on the lateral side of the foot, the lateral first and second flexible portions 21 and 22 similarly shrank in the front-back direction.

Here, "shrinking of the flexible portions 11 to 13 and 21 to 23" means that a ruck occurs along a direction in which each flexible portion extends, whereby the anterior edge of the flexible portion comes closer to the posterior edge (e.g., the posterior edge 11*b* of the medial first flexible portion 11 comes closer to the anterior edge 11*f*), thereby decreasing the distance from the anterior edge to the posterior edge of one flexible portion.

Note that a ruck R along the transverse direction X occurred in the main portion 10 between the medial and lateral flexible portions.

The shrinkage was very small with the medial third flexible portion 13 and the lateral third flexible portion 23 in the tip area.

Figure 4C:
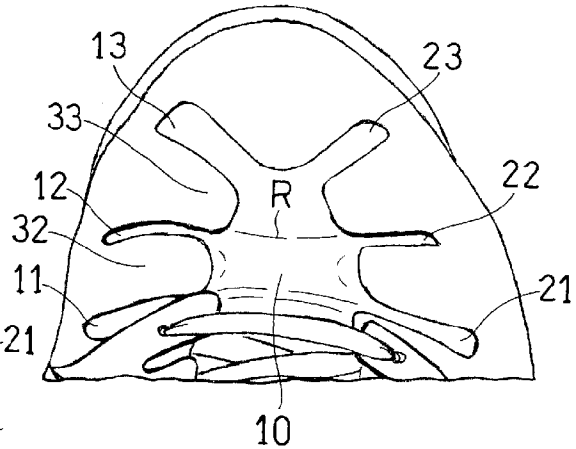

When the heel was further raised for greater dorsiflexion of the foot, there was a greater shrinkage and greater ruck R in the medial flexible portions 11 and 12 and the lateral flexible portions 21 and 22 as shown in FIG. 4C.

Note that there was a slight shrinkage also in the medial third flexible portion 13 and the lateral third flexible portion 23 in the tip area.

From these results, it is presumed that the provision of the medial second flexible portion 12 and the lateral second flexible portion 22 at positions anterior to the medial first flexible portion 11 and the lateral first flexible portion 21, respectively, is effective for when the foot is bent significantly.

Figure 5A:
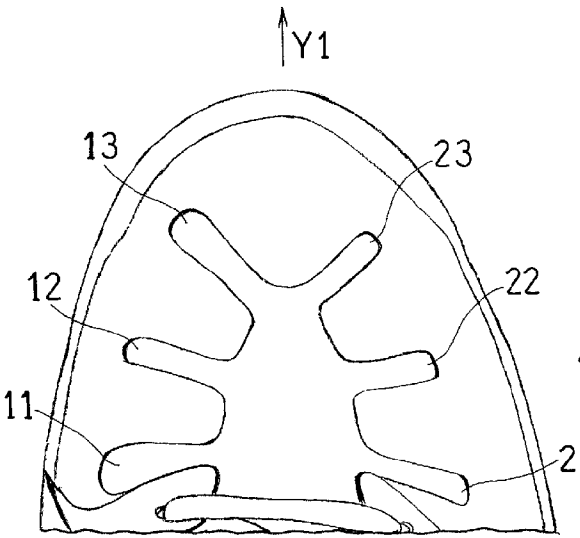
FIGS. 5A, 5B and 5C are plan views showing the deformation of the front foot portion before the foot is bent, when the foot is supinated, and when the foot is pronated.
Figure 5B:
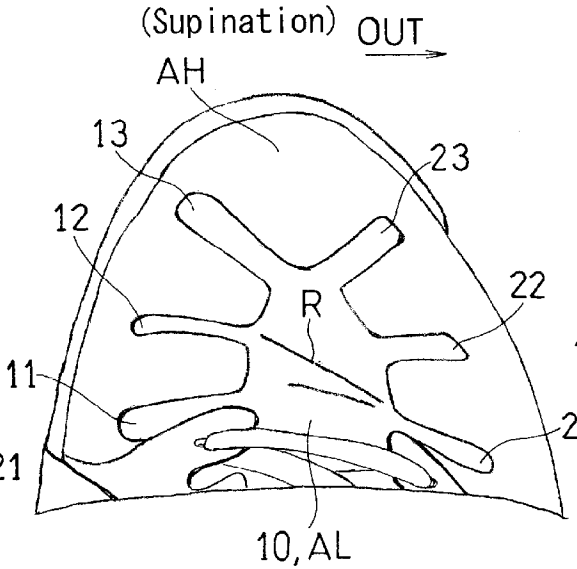

FIG. 5A shows a state of the upper U in a standing position similar to FIG. 4A, and as the heel was raised from this state into "supination", the medial first flexible portion 11 slightly shrank in the front-back direction while the medial second flexible portion 12 and the lateral first flexible portion 21 significantly shrank in the front-back direction as shown in FIG. 5B. Between the medial second flexible portion 12 and the lateral first flexible portion 21, there was a ruck R in the main portion 10 that was continuous with the medial second flexible portion 12 and the lateral first flexible portion 21.

In this case, there was a small shrinkage in the medial third flexible portion 13, the lateral second flexible portion 22 and the lateral third flexible portion 23.

Thus, the reason for the increase in the shrinkage of the medial second flexible portion 12 and the lateral first flexible portion 21 in the case of "supination" is presumed to be that the foot bends along the bend line L2 of FIGS. 7 and 9A.

While the bend line L2 of the foot was curved so as to be protruding in the backward direction Y2, the ruck R in the upper of FIG. 5B was like a straight line or slightly curved to be protruding in the forward direction Y1. It is believed that the bend line of the foot and that of the upper are slightly different from each other for reasons such as a curved ruck being less likely to occur in a sheet-like upper unlike in the foot, the periphery of the upper being constrained, and the upper deforming so as to be separated from the foot in an upward direction.

Figure 5C:
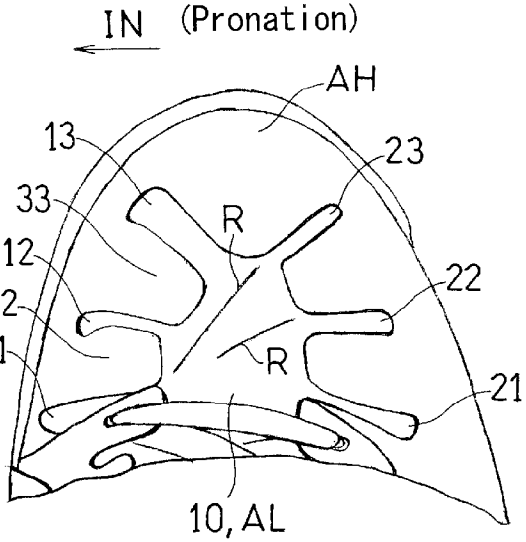
Figure 5C:
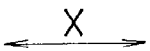

On the other hand, as the heel was raised from the state of the standing position of FIG. 5A into "pronation", a ruck occurred in the medial first flexible portion 11 and the lateral third flexible portion 23 as shown in FIG. 5C, thereby significantly shrinking these portions. A ruck R also occurred in the main portion 10 between the medial first flexible portion 11 and the lateral third flexible portion 23.

Thus, the reason for the increase in the shrinkage of the medial first flexible portion 11 and the lateral third flexible portion 23 in the case of "pronation" is presumed to be that the foot bends along the bend line L3 of FIGS. 7 and 9A.

"Pronation" can be done to a greater degree than "supination", and "pronation" is sometimes done significantly during exercises such as an on-court sport, for example.

As the "pronation." was further increased, the ruck R of the main portion 10 and the ruck or shrink of the medial first flexible portion 11 and the lateral third flexible portion 23 increased as shown in FIG. 5C, with a shrink or ruck also occurring in the lateral first flexible portion 21, and a shrink or ruck further occurring also in the medial second flexible portion 12, the lateral second flexible portion 22. A ruck R also occurred in the main portion 10 between the medial first flexible portion 11 and the lateral second flexible portion 22.

Therefore, it is presumed that the medial second flexible portion 12 and the lateral first flexible portion 21 function advantageously for "pronation".

In order for a ruck to occur in the main portion 10 between the medial and lateral flexible portions as described above, the width of the main portion 10 of FIG. 7 in the transverse direction X is preferably 40 mm or less and 10 mm or more in an area including the second proximal phalanx $B3_2$, and is more preferably 13 mm or more, and most preferably 15 mm or more. The length of the main portion 10 in the front-back direction Y from the base of the second proximal phalanx $B3_2$ is preferably 60 mm or less and 15 mm or more, and is more preferably 20 mm or more, and is most preferably 25 mm or more. The main portion 10 preferably extends from the head of the second metatarsal bone $B4_2$ to the head of the first or second proximal phalanges $B3_1$ or $B3_2$.

Figure 10B:
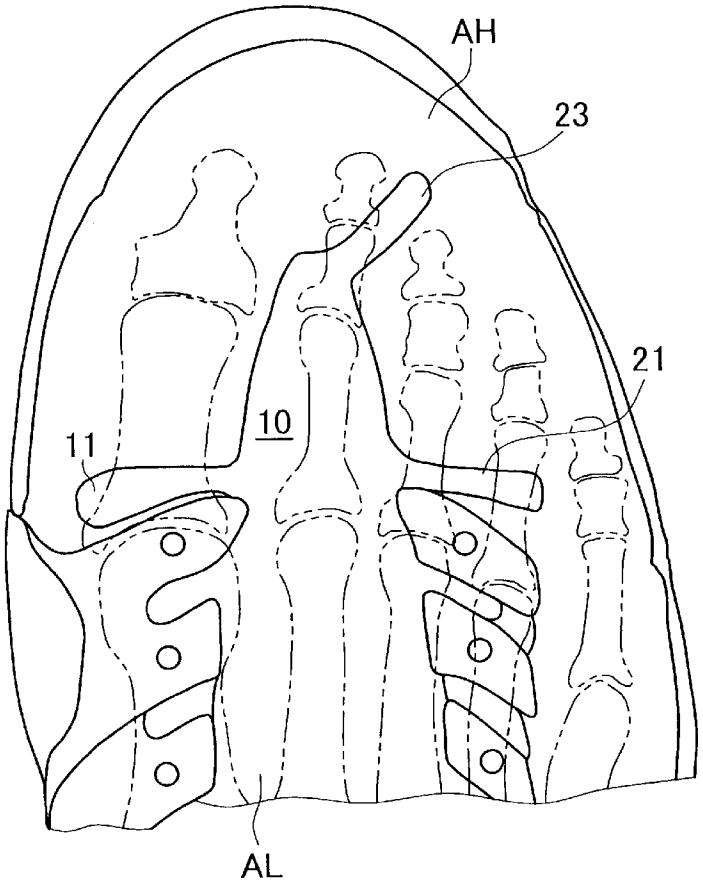
FIG. 10B is a plan view showing the same of a shoe of Example 3 of the present invention.
Figure 10A:
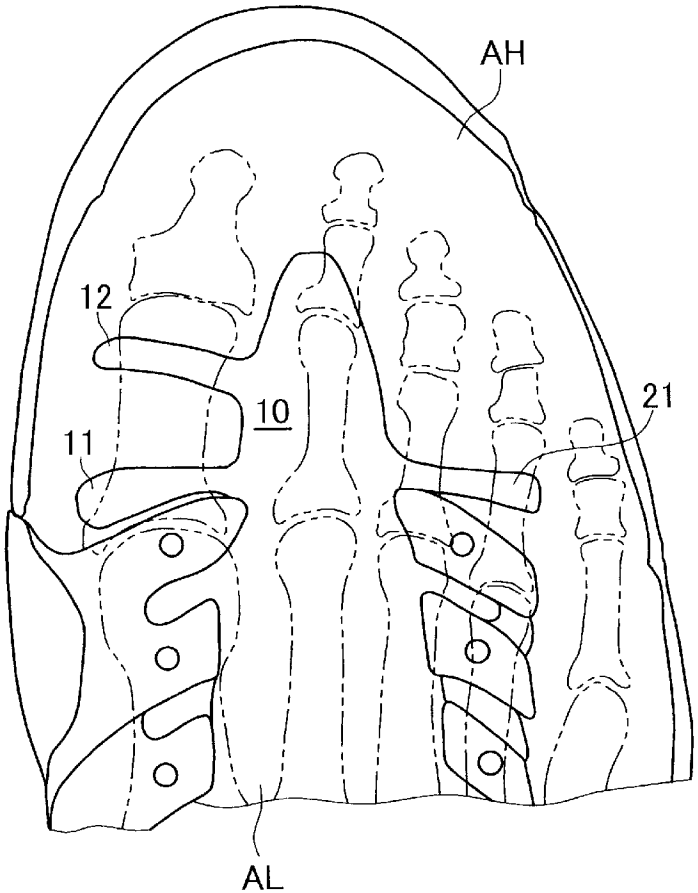
FIG. 10A is a plan view showing flexible portions and diagonal portions of a shoe of Example 2 of the present invention.

In view of the results of the test, a structure suitable for "supination" will be obtained also when only the medial second flexible portion 12 is provided as a diagonal portion, besides the medial first flexible portion 11 and the lateral first flexible portion 21, as shown in FIG. 10A. On the other hand, a structure suitable for "pronation" will be obtained also when only the lateral third flexible portion 23 is provided as a diagonal portion, besides the medial first flexible portion 11 and the lateral first flexible portion 21, as shown in FIG. 10B.

Figure 11B:
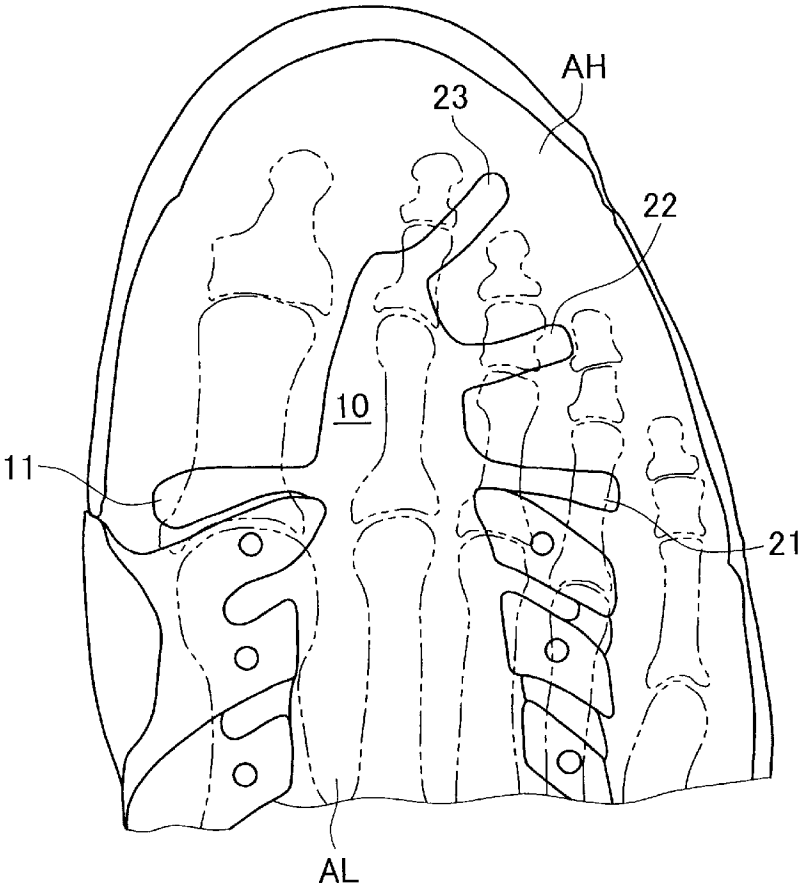
FIG. 11B is a plan view showing the same of a shoe of Example 5 of the present invention.
Figure 11A:
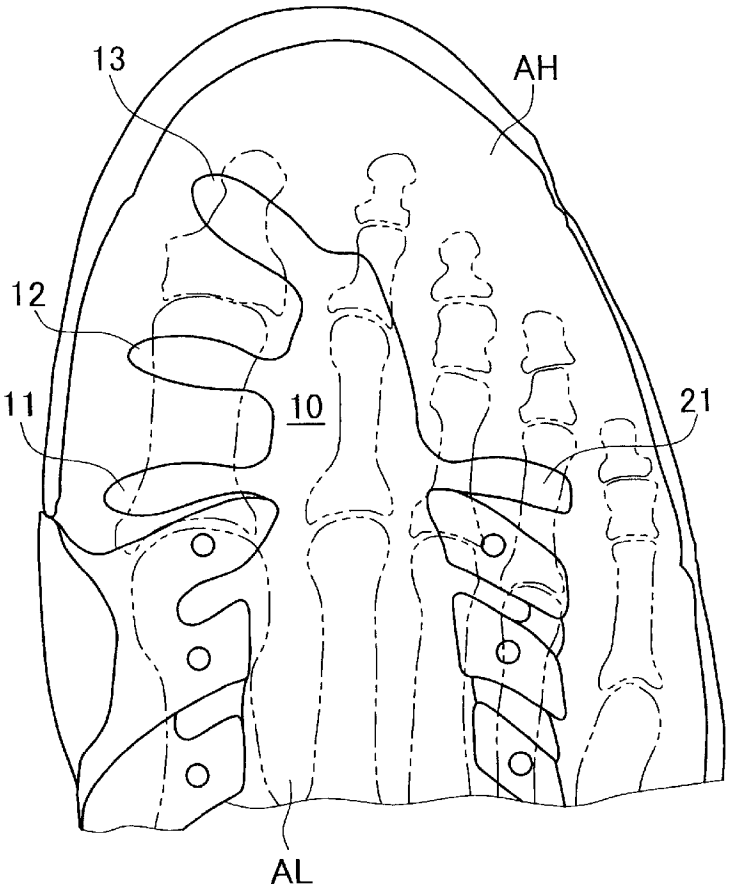
FIG. 11A is a plan view showing flexible portions and diagonal portions of a shoe of Example 4 of the present invention.

It will be a structure suitable for "supination" when only the flexible portions 12 and 13 on the medial side are provided as diagonal portions, besides the medial first flexible portion 11 and the lateral first flexible portion 21, as shown in FIG. 11A. On the other hand, it will be a structure suitable for "pronation" when only the lateral flexible portions 22 and 23 on the lateral side are provided as diagonal portions, besides the medial first flexible portion 11 and the lateral first flexible portion 21, as shown in FIG. 11B.

Figure 12B:
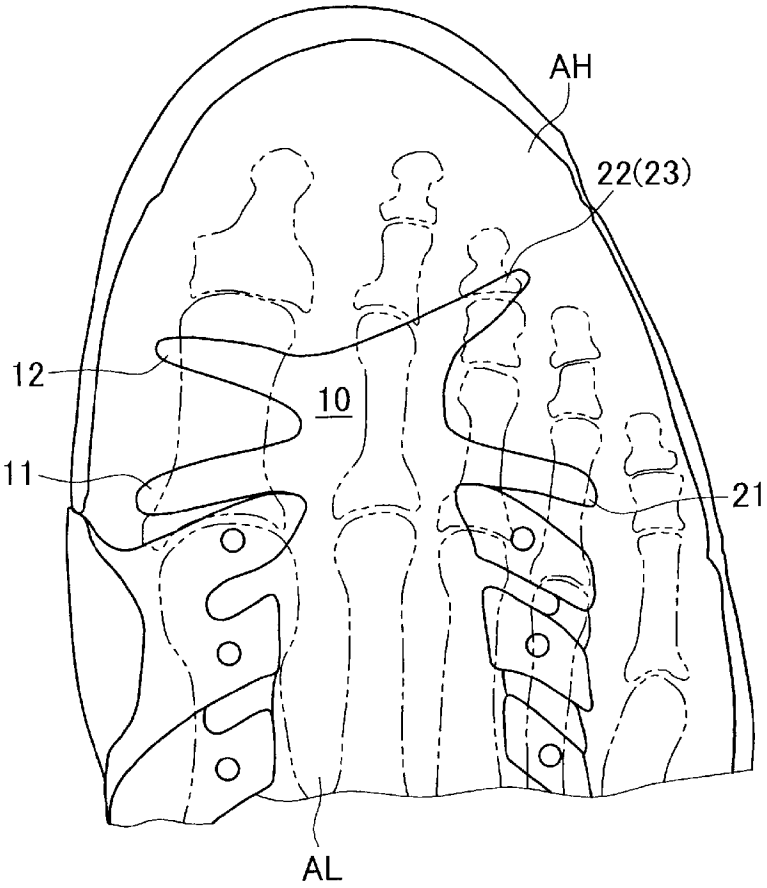
FIG. 12B is a plan view showing the same of a shoe of Example 7 of the present invention.
Figure 12A:
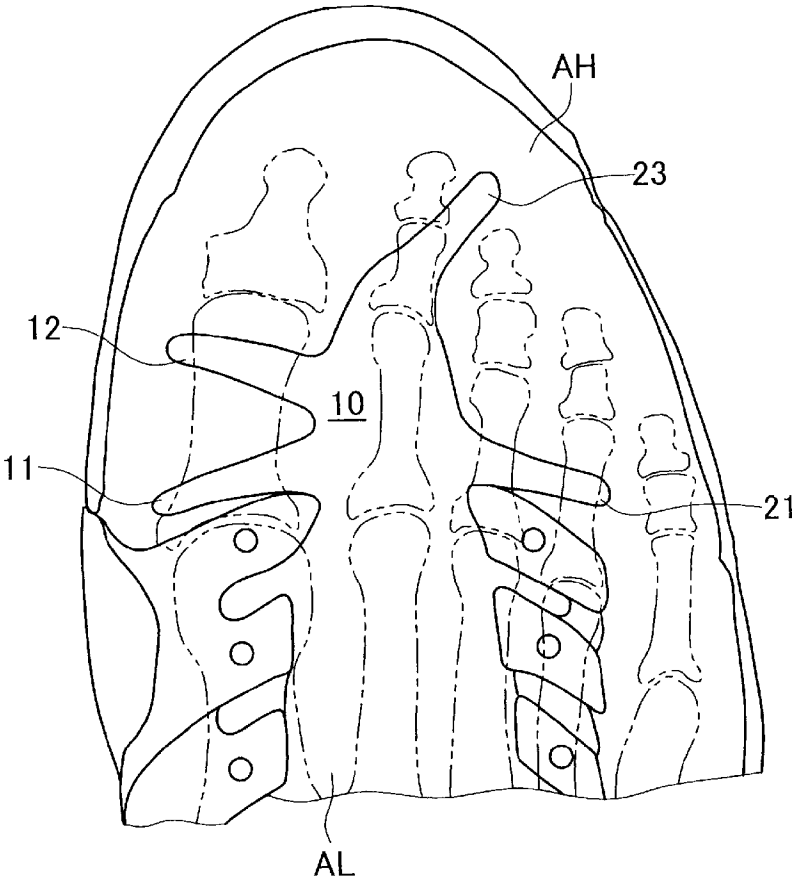
FIG. 12A is a plan view showing flexible portions and diagonal portions of a shoe of Example 6 of the present invention.

A structure suitable for both "supination" and "pronation" will be obtained when the medial second flexible portion 12 and the lateral third flexible portion 23 are provided as diagonal portions, besides the medial first flexible portion 11 and the lateral first flexible portion 21, as shown in FIG. 12A.

In the test of "pronation" of FIG. 5C, the lateral second flexible portion 22 deformed while the heel raise was small and the "pronation" was small. Therefore, where the "pronation" is small and the heel raise was small, it will be preferred to provide both the medial second flexible portion 12 and the lateral second flexible portion 22 as diagonal portions, besides the medial first flexible portion 11 and the lateral first flexible portion 21, as shown in FIG. 12B.

Figure 13B:
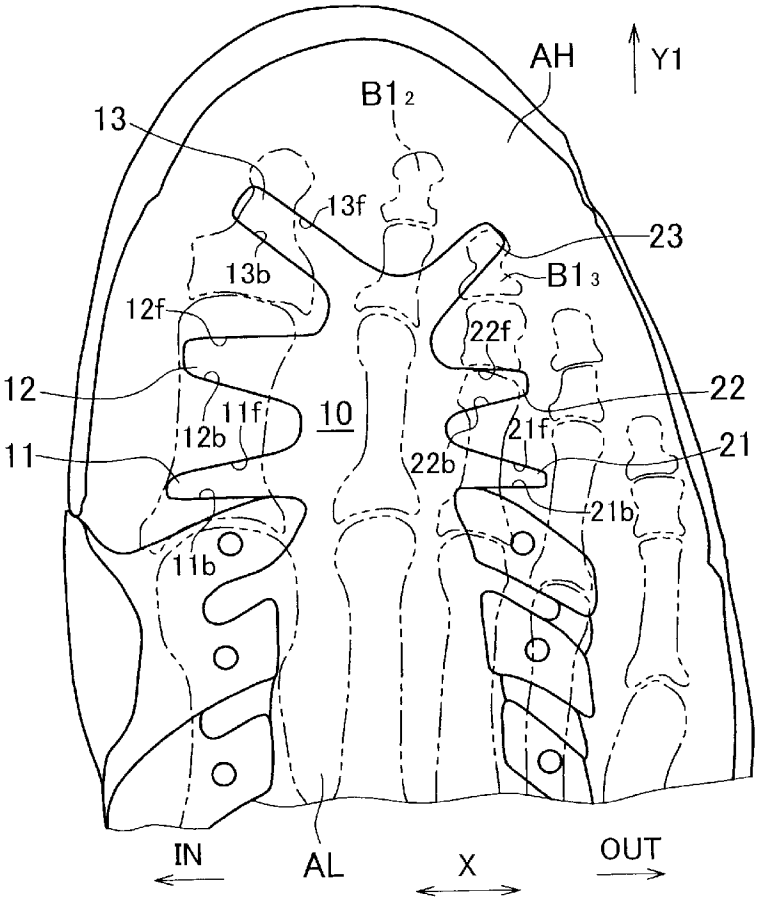
FIG. 13B is a plan view showing the same of a shoe of Example 9 of the present invention.
Figure 13A:
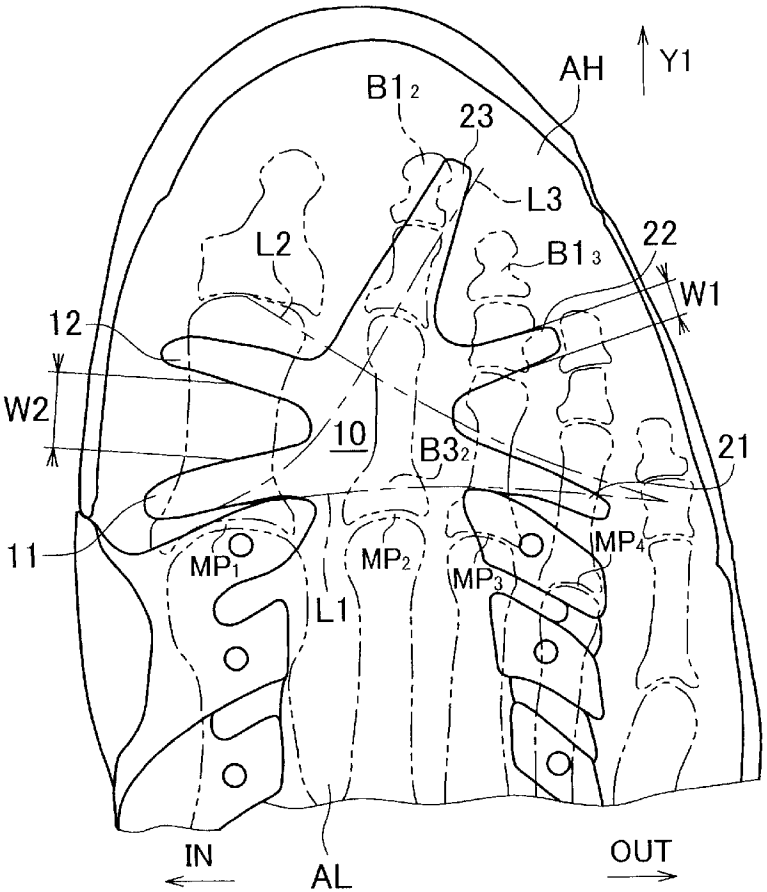
FIG. 13A is a plan view showing flexible portions and diagonal portions of a shoe of Example 8 of the present invention.

In the present invention, it is preferred that the medial first flexible portion 11 and the lateral first flexible portion 21 of FIG. 13A are arranged along the bend line L1, which is protruding in the forward direction, and that a large portion of the bend line L1 is included by the medial first flexible portion 11, the main portion 10 and the lateral first flexible portion 21.

Similarly, it will be preferred that a large portion of the bend line L2 is included by the medial second flexible portion 12, the main portion 10 and the lateral first flexible portion 21, and it will be preferred that a large portion of the bend line L3 is included by the medial first flexible portion 11, the main portion 10 and the lateral third flexible portion 23.

From such a viewpoint, it is preferred that the depressed portions forming the medial flexible portions 11 and 12 and the lateral flexible portions 21 to 23 are each formed so that the width W1 of the depressed portion increases gradually toward the main portion 10, as shown in FIG. 13A. In this case, each depressed portion is likely to include a smooth curve. Therefore, the medial first flexible portion 11 and the lateral first flexible portion 21 are likely to be arranged along the bend line L1, the medial second flexible portion 12 and the lateral first flexible portion 21 are likely to be arranged along the bend line L2, and the medial first flexible portion 11 and the lateral third flexible portion 23 are likely to be arranged along the bend line L3.

Note that the width W1 of the depressed portion (the flexible portions 11 to 13 (FIG. 13B) and 21 to 23) means the length thereof in a direction perpendicular to the direction in which the depressed portion extends from the main portion 10 (the distance between the anterior edge and the posterior edge thereof).

On the other hand, the protruding portions (the reinforcement portions 32 to 34, 42 and 43 of FIG. 6A) sandwiched between the depressed portions are each formed in a shape that is tapered toward the main portion 10. That is, each protruding portion is formed so that the width W2 thereof decreases gradually toward the main portion 10.

Note that the width W2 of the protruding portions (the reinforcement portions 32 to 34, 42 and 43) means the length of each protruding portion in a direction perpendicular to the direction in which the protruding portion extends from the main portion 10.

In the present invention, it will be preferred that the medial first flexible portion 11 and the lateral first flexible portion 21 of FIG. 13A are along, but slightly shifted forward from, a line connecting between the MP joint $MP_1$ of the first toe to the MP joint $MP_4$ of the fourth toe, it will be preferred that a portion or whole of the medial first flexible portion 11 is smoothly continuous with the diagonal portions 22 and 23 on the lateral side via the main portion 10. On the other hand, it will be preferred that a portion or whole of the lateral first flexible portion 21 is smoothly continuous with the diagonal portions 12 and 13 on the medial side via the main portion 10.

From such a viewpoint, it is preferred that the medial first flexible portion 11 extends gradually toward the medial side IN in a diagonally backward direction as it is away from the main portion 10. On the other hand, it is preferred that the lateral first flexible portion 21 extends gradually toward the lateral side OUT in a diagonally backward direction as it is away from the main portion 10.

Here, the directions in which the flexible portions 11 to 13 and 21 to 23 of FIG. 7 extend means the directions in which the virtual center lines 11*c* to 13*c* and 21*c* to 23*c* extend, which bisect the flexible portions 11 to 13 and 21 to 23 of FIG. 6A in a front-back or diagonal direction.

Therefore, as shown in FIG. 13B, the posterior edges 11*b* and 21*b* of the medial and lateral first flexible portions 11 and 21 may extend in a just horizontal direction, and the anterior edges 11*f* and 21*f* may extend in a diagonally backward direction from the main portion 10. The anterior edges 12*f* and 22*f* of the medial and lateral second flexible portions 12 and 22 may extend in a just horizontal direction, and the posterior edges 12*b* and 22*b* may extend in a diagonally forward direction from the main portion 10.

In the present invention, it is preferred that the main portion 10 of FIG. 7 covers, as a portion of the region 10*c*, the head of the second metatarsal bone $B4_2$. This is for suppressing an increase in the contact pressure at the measurement point S2 (FIG. 9A), i.e., the head of the second metatarsal bone $B4_2$.

It is preferred that the posterior edge 11*b* of the medial first flexible portion 11 and the anterior edge 12*f* of the medial second flexible portion 12 are arranged anterior to the metatarsal phalangeal joint $MP_1$ and posterior to the interphalangeal joint $J_1$. Such an arrangement will suppress an increase in the contact pressure at the measurement point S4 (FIG. 9A), the proximal phalanx $B3_1$.

In order to decrease the contact pressure, it is preferred that the medial first and second flexible portions 11 and 12 extend to a position more on the medial side IN than the ridgeline L10 of the first proximal phalanx $B3_1$.

It is preferred that the posterior edge 21*b* of the lateral first flexible portion 21 is arranged anterior to the MP joint $MP_3$. Such an arrangement will suppress an increase in the contact pressure at the measurement point S5 (FIG. 9A), i.e., the proximal phalanx $B3_3$.

In order for the contact pressure in this area to be small, the lateral first flexible portion 21 preferably extends to a position more on the lateral side OUT than the ridgeline L30 of the third proximal phalanx $B3_3$, and more preferably extends to a position more on the OUT side than the outer edge of the fourth proximal phalanx $B3_4$.

As shown in FIGS. 7, 13A and 13B, the lateral third flexible portion 23 preferably extends to a position more on the lateral side OUT than the outer edge of the distal phalanx $B1_2$ of the second toe and extends to a position anterior Y1 to the tip of the distal phalanx $B1_3$ of the third toe.

In such a case, the upper bends easily along the bend line L3 of FIG. 13A.

FIGS. 14A to 16C show Example 10.

Example 10 differs from Example 1 of FIG. 7 in that the medial and lateral first flexible portions 11 and 21 extend in a slightly diagonally backward direction while the medial and lateral second flexible portions 12 and 22 extend in a diagonally forward direction that is close to a just horizontal direction.

Next, how the upper U deforms when a shoe of Example 10 is worn on a foot and the foot is dorsiflexed will be described.

Figure 15:
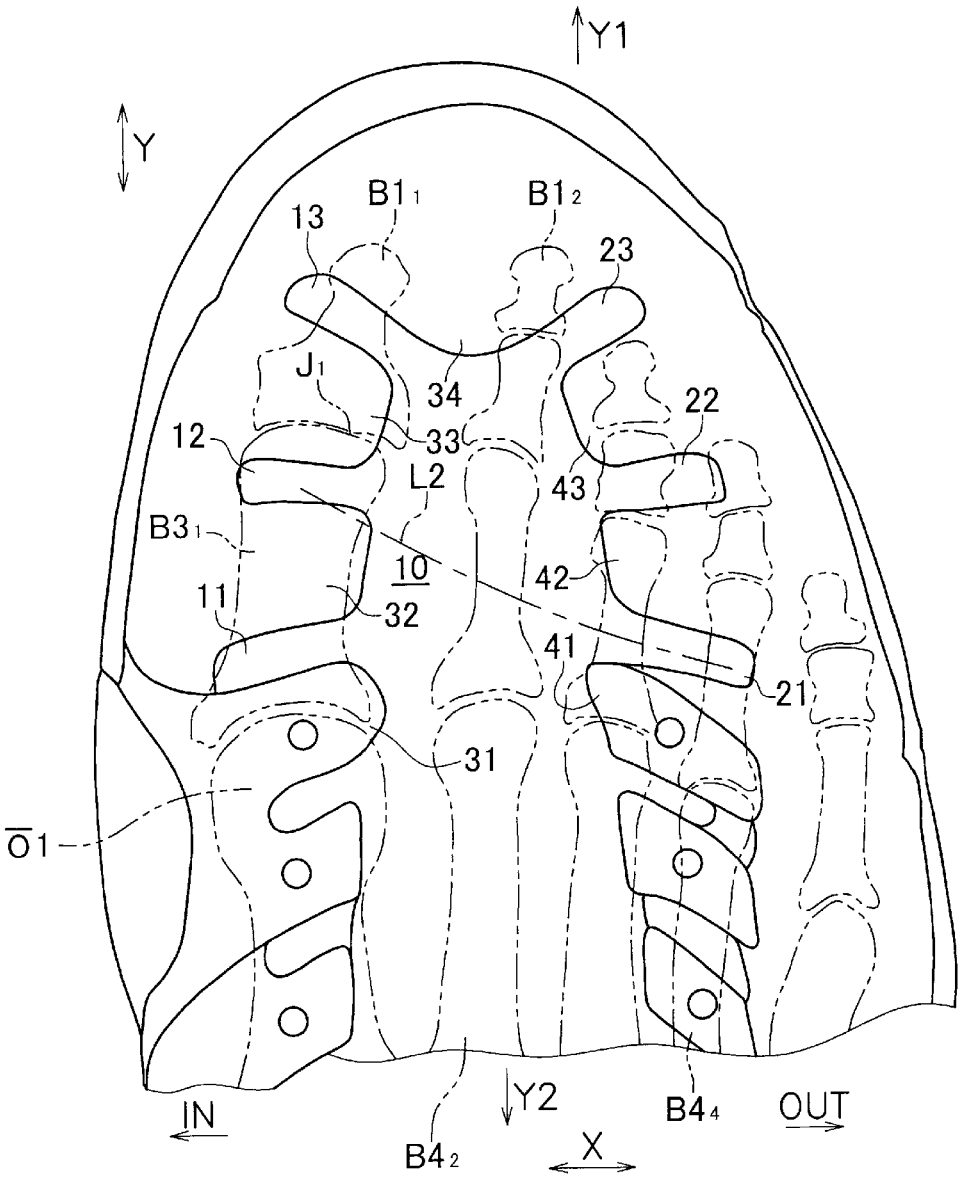
FIG. 15 is a plan view of the front foot portion showing the relationship between the low rigidity region and the high rigidity region of Example 10 and the bone structure of the foot.
Figure 16A:
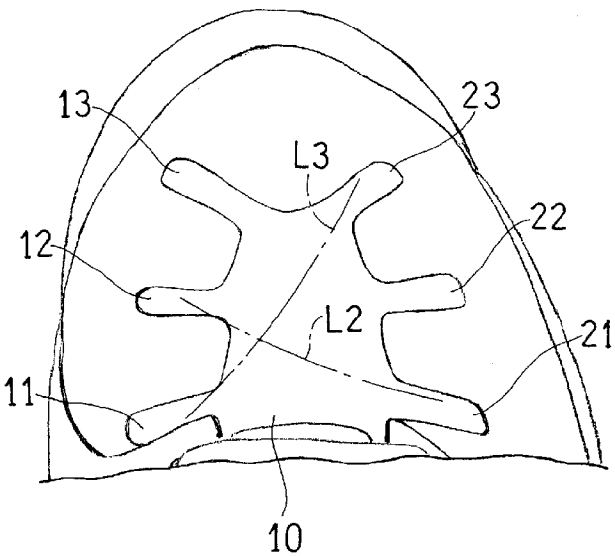
FIGS. 16A, 16B and 16C are plan views showing the deformation of the front foot portion before the foot is bent, when the foot is supinated, and when the foot is pronated.
Figure 16B:
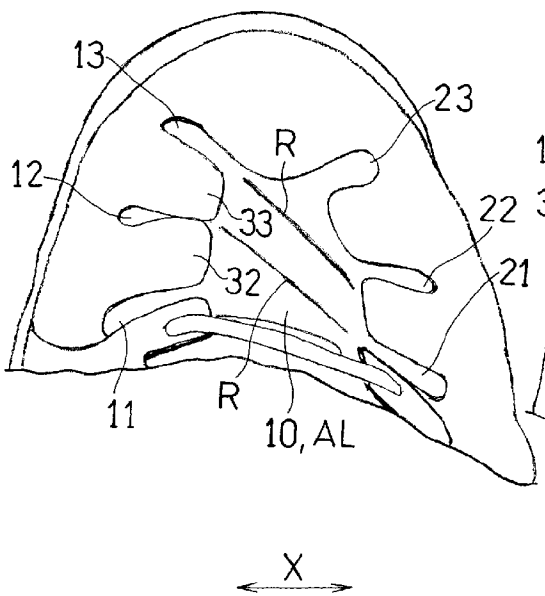
Figure 16C:
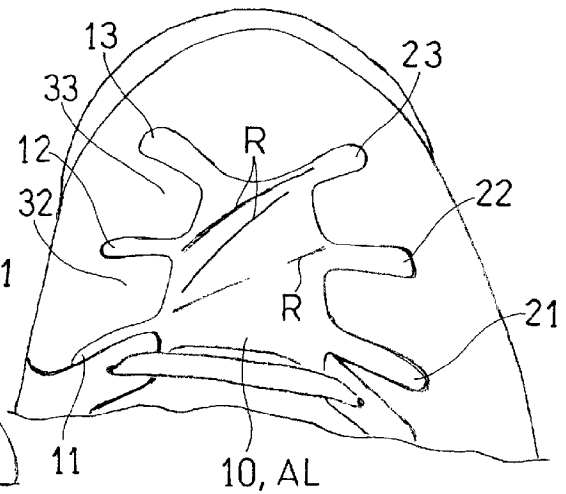

FIG. 16A shows a state of the upper U in a standing position similar to FIG. 15. As the heel was raised from this state into "supination", the upper U exhibited a deformation as shown in FIG. 16B. As shown in FIG. 16B, the medial second flexible portion 12 deformed to such a degree that the medial second reinforcement portion 32 and the medial third reinforcement portion 33 overlapped each other on top of each other, and the deformation of the upper was not as smooth as that of FIG. 5B.

It is presumed that the reason for such a phenomenon is that the band-like areas of the medial second flexible portion 12 and the lateral first flexible portion 21 of FIG. 16A which are continuous with each other via the main portion 10 are not smoothly continuous with each other along the bend line L2.

On the other hand, in "supination", the first toe of FIG. 15 will be in such a state where the ball O1 of the big toe is off the ground, the distal phalanx $B1_1$ is in contact with the ground, and the heads of the second to fourth metatarsal bones $B4_2$ to $B4_4$ are in contact with the ground. Therefore, the medial second flexible portion 12 preferably extends along the bend line L2 which is anterior to a line connecting between the metatarsal phalangeal joints $MP_2$ to $MP_4$ (not shown) and is generally parallel to this line.

That is, it is preferred that the medial second flexible portion 12 covers a portion of the anterior half of the proximal phalanx $B3_1$ and extends diagonally across the entirety of the proximal phalanx $B3_1$ in an area posterior to the interphalangeal joint $J_1$, and it is preferred that the medial second flexible portion 12 extends along the bend line L2.

For such reasons, the angle $\alpha_{12}$ formed between the center line 12*c* of the medial second flexible portion 12 of FIG. 7 and a virtual line along the transverse direction X is preferably 5° or more, more preferably 10° or more, and most preferably 15° or more.

The angle $\alpha_{12}$ is preferably 40° or less, more preferably 35° or less, and most preferably 30° or less.

For similar reasons, the angle $\beta_{12}$ formed between the line of the posterior edge 12*b* of the medial second flexible portion 12 of FIG. 6A and a virtual line in the transverse direction X is preferably 5° or more, more preferably 10° or more, and most preferably 15° or more.

The angle $\beta_{12}$ is preferably 40° or less, more preferably 35° or less, and most preferably 30° or less.

Note that the angle β formed between the line of the posterior edge and a virtual line along the transverse direction X should be defined as the angle β formed between the virtual line and a tangential line (or an envelope) in the middle portion of the flexible portion between the base and the tip thereof.

The inclination of the medial and lateral flexible portions 13 and 23 of Example 9 of FIG. 15 with respect to the transverse direction X is smaller than that of Example 1 of FIG. 7.

As the heel was raised from the state of the standing position of FIG. 16A into "pronation", a line of ruck occurred extending from the lateral third flexible portion 23 toward the medial first and second flexible portions 11 and 12, and a line of ruck occurred from the lateral second flexible portion 22 toward the medial first flexible portion 11, whereby the bending of the upper U was not as smooth as in Example 1.

That is, it is presumed that the reason why the bending is not smooth is that, in the case of this example, the inclination of the lateral third flexible portion 23 is small, whereby areas of the lateral third flexible portion 23 and the medial first flexible portion 11 which are continuous with each other via the main portion 10 are not smoothly continuous with each other along the bend line L3.

In "pronation", a large ground pressure is applied to the ball O1 of the big toe and the distal phalanx $B1_1$ of the big toe of FIG. 15, and a small ground pressure is applied to the distal phalanx $B1_2$ of the second toe. Therefore, it is preferred that the main portion 10 or the lateral third flexible portion 23 covers a portion or whole of the head of the proximal phalanx $B3_2$ along the bend line L3 as shown in FIG. 13A (FIG. 13B) and that the lateral third flexible portion 23 of FIG. 13A (FIG. 13B) extends into a portion of the distal phalanx $B1_2$ or $B1_3$ of the second toe or the third toe, or to a position between the two distal phalanges $B1_2$ and $B1_3$ as shown in FIG. 7.

For such a reason, the angle $\alpha_{23}$ formed between the center line 23*c* of the lateral third flexible portion 23 of FIG. 7 and a line in the transverse direction X, and the angle $\beta_3$ formed between the line of the posterior edge 23*b* of the lateral third flexible portion 23 of FIG. 6A and the above line are preferably 25° or more, more preferably 35° or more, and most preferably 10° or more.

On the other hand, the angle $\beta_{23}$ of FIG. 6A and the angle $\alpha_{23}$ of FIG. 7 are preferably 70° or less, more preferably 65° or less, and most preferably 60° or less.

Now, the material of the upper is a planar, sheet-like member that is deformed into a three-dimensional shape during manufacture. Such deformation may cause errors in the shape, dimension, inclination and arrangement of the flexible portions 11 to 13 and 21 to 23. Therefore, such manufacturing errors need to be taken into consideration when designing the upper.

Figure 17:
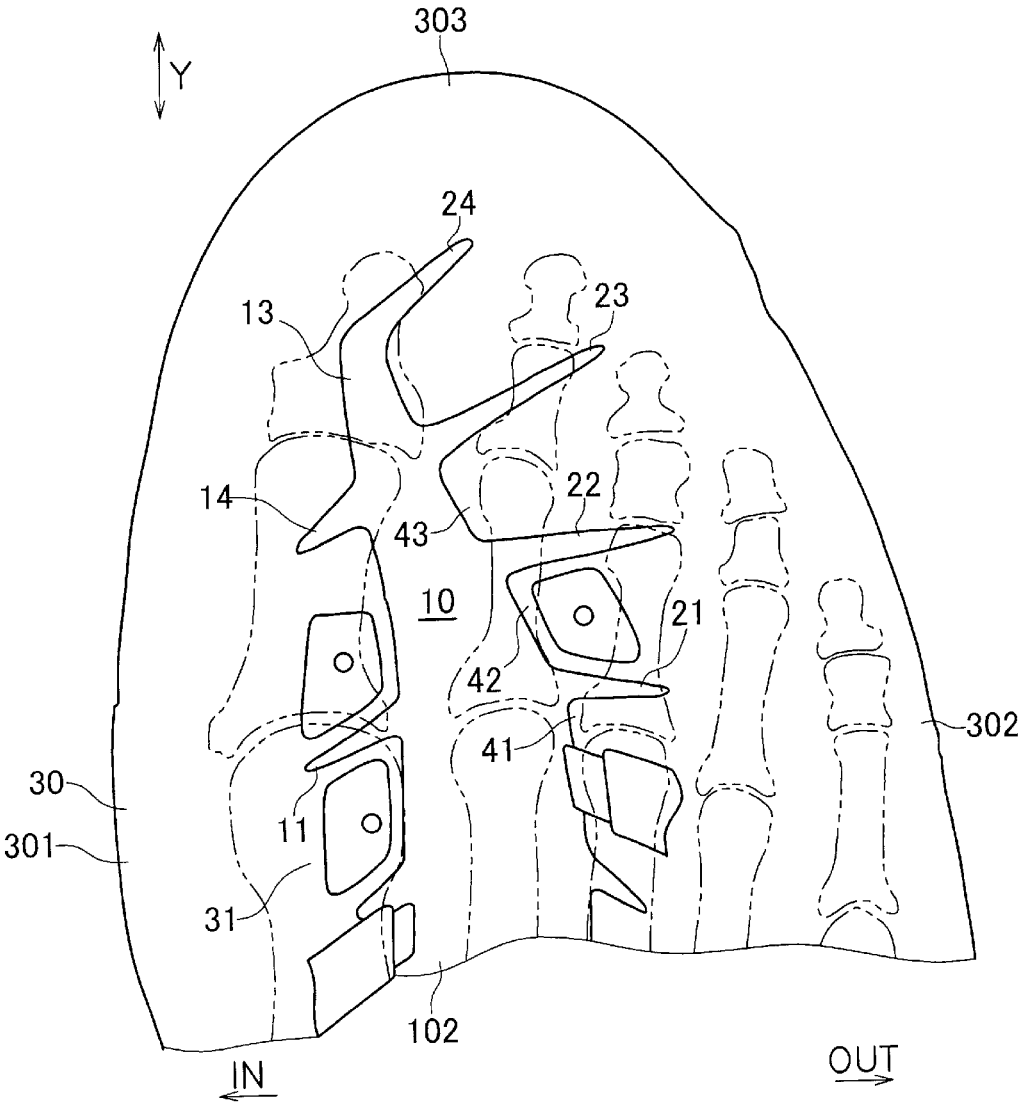
FIG. 17 is a plan view of the front foot portion showing an upper of Example 11, and showing the relationship between the low rigidity region, the high rigidity region, and the bone structure of the foot.
Figure 18:
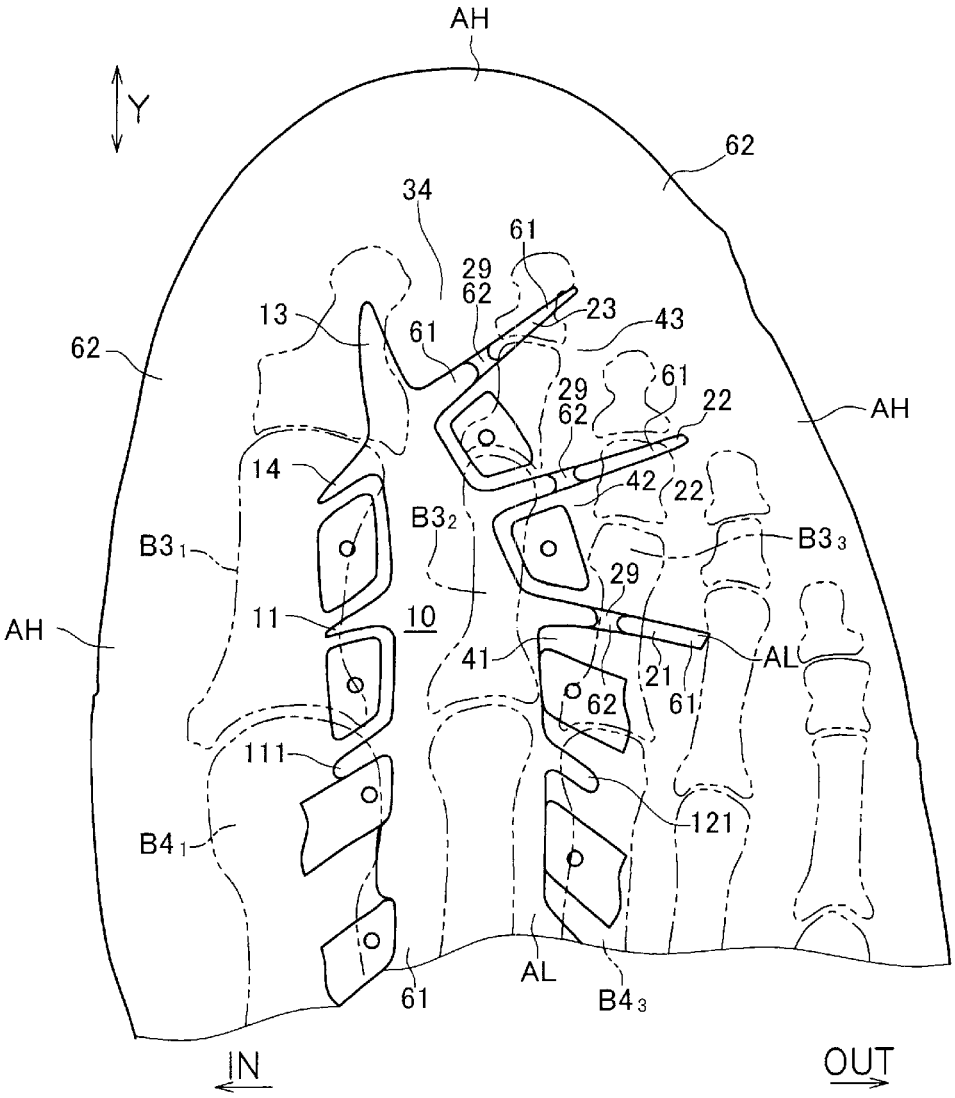
FIG. 18 is a plan view of the front foot portion showing an upper of Example 12, and showing the relationship between the low rigidity region, the high rigidity region, and the bone structure of the foot.

In the example of FIGS. 17 and 18, the second opening 102 is inclined toward the medial side along the ridgeline of the instep. PCT/JP2007/69809 (WO2008/047659A1) having a structure of such a second opening has been filed with the USPTO, and the entire content of which is incorporated herein by reference.

The second opening 102 is provided so that the center line extends along the ridgeline of the instep from the first toe to the second toe. That is, the center line of the second opening 102 is inclined toward the medial side IN of the foot in the anterior direction of the foot, and is thus inclined with respect to the front back direction Y of the foot.

In the example of FIG. 17, the medial third flexible portion 13 is smoothly continuous with the main portion 10. The fourth flexible portion 24, which forms one of the diagonal portions, is provided anterior to the lateral third flexible portion 23.

Thus, four or more of each of the medial and lateral flexible portions may be provided as long as it does not essentially inhibit the functions and advantageous effects of the present invention. Another flexible portion, different from the second flexible portion, may be provided between the first flexible portion and the third flexible portion.

An auxiliary flexible portion 14 is provided, which is smoothly continuous with the lateral third flexible portion 23 via the main portion 10. The auxiliary flexible portion 14 extends in a diagonally backward direction from the main portion 10 on the medial side of the instep.

This upper will be suitable for "pronation".

There are positions between the flexible portions at which eyelet members are provided, and a shoe lace passes above the main portion 10.

In the example of FIG. 18, the medial first flexible portion 11 and the lateral first flexible portion 21 cover portions of the shafts of the first and third proximal phalanges $B3_1$ and $B3_3$, respectively, and the notch portions 111 and 121 are provided generally parallel to the medial first flexible portion 11 and the lateral first flexible portion 21. These notch portions 111 and 121 are formed in areas of the heads of the first and third metatarsal bones $B4_1$ and $B4_3$, respectively.

In this example, the lateral first to third flexible portions 21 to 23 may be reinforced in some portions by layering the second member 62 on the first member 61. Even if the flexible portions are locally reinforced, the ease of bending of the flexible portions 21 to 23 will not be substantially detracted from, and errors due to deformation during manufacture will be unlikely to occur in the flexible portions 21 to 23.

In the case of this example, in the flexible portions 21 to 23, connecting portions 29 reinforced with the second member 62 are connecting between the reinforcement portions 41, 42, 43 and 34 anterior/posterior to the flexible portions 21 to 23.

Thus, manufacturing errors will be unlikely to occur in the distance between adjacent reinforcement, portions (e.g., 43 and 34), i.e., the width of the flexible portions 21 to 23.

The locally-reinforced connecting portions 29 will bend together with the flexible portions 21 to 23 when the foot is bent. That is, even when there is a portion 29 locally reinforced with the second member 62 in the flexible portions 21 to 23, the portion 29 should also be regarded as being part of the flexible portions 21 to 23 if the reinforced portion 29 is more bendable than the high rigidity region AH.

In other words, in the present invention, the flexible portions 21 to 23 are only required to be more stretchable and bendable than the high rigidity region AH and essentially continuous with the main portion 10, and they may be continuous with the main portion 10 via the connecting portion 29.

Note that it will be preferred that the position at which the connecting portion 29 is provided is slightly away from the main portion 10 in the direction in which the flexible portion extends.

INDUSTRIAL APPLICABILITY

The present invention is applicable to a structure for a front foot portion of an upper of regular athletic shoes, as well as shoes for on-court sports.

REFERENCE SIGNS LIST

10: Main portion, 10*c*: Core region, 11: Medial first flexible portion, 12: Medial second flexible portion, 13: Medial third flexible portion

21: Lateral first flexible portion, 22: Lateral second flexible portion, 23: Lateral third flexible portion

11*f*, 12*f*, 13*f*, 21*f*, 22*f*, 23*f*: Anterior edge, 11*b*, 12*b*, 13*b*, 21*b*, 22*b*, 23*b*: Posterior edge, 11*c* to 13*c*, 21*c* to 23*c*: Center line

31: Medial first reinforcement portion (medial posterior reinforcement portion), 32: Medial second reinforcement portion (medial anterior reinforcement portion), 33: Medial third reinforcement portion, 34: Tip reinforcement portion

41: Lateral first reinforcement portion (lateral posterior reinforcement portion), 42: Lateral second reinforcement portion (lateral anterior reinforcement portion), 43: Lateral third reinforcement portion

30: Peripheral portion, 301: Medial side edge portion, 302: Lateral side edge portion 303: Tip edge portion

51: Outer sole, 51*a*: Roll-up portion, 52: Mid sole, 52*a*: Roll-up portion

61: First member, 62: Second member, 63: Third member, 64: Through holes, 65: Ridge portion AL: Low rigidity region, $AH_i$: High rigidity region L1: First bend line, L2: Second bend line, L3: Third bend line, L10, L30: Ridgeline α, β: Angle

100: Insertion hole, 101: First opening, 102: Second opening, 103: Shoe lace O1: Ball of big toe, $B1_i$: Distal phalanx, $B3_i$: Proximal phalanx, $B4_i$: Metatarsal bone $J_i$: Interphalangeal joint $MP_i$: Metatarsal phalangeal joint (MP joint)

The invention claimed is:

1. A structure for a front foot portion of an upper of a shoe comprising: soles adapted to support a foot sole; and the upper adapted to cover an instep, wherein:

the front foot portion of the upper includes a low rigidity region and a high rigidity region that has a rigidity higher than a rigidity of the low rigidity region;

the low rigidity region is formed by a first member that forms the upper, the first member including at least one of a mesh fabric, a knitted fabric, a woven fabric, a non-woven fabric, a synthetic leather, and a natural leather;

the high rigidity region is formed by the first member and a second member that is layered on a surface of the first member and is less stretchable than the first member; and the low rigidity region is adapted to cover a portion of tips of toes of a foot, and is more stretchable and bendable than the high rigidity region, the low rigidity region comprising:

a main portion extending in a front-back direction of the foot and in a transverse direction perpendicular to the front-back direction in a middle between a medial side and a lateral side of the front foot portion, and adapted to include a portion of an area from a shaft of a first proximal phalanx to a shaft of a second proximal phalanx;

a medial first flexible portion adapted to cover a portion of an area from the shaft of the first proximal phalanx to a head of a first metatarsal bone, extending toward the medial side of the foot from the main portion in the transverse direction or in a diagonally posterior direction, and being continuous with the main portion;

a lateral first flexible portion adapted to cover a portion of an area from a shaft to a base of a third proximal phalanx or a fourth proximal phalanx, extending toward the lateral side of the foot from the main portion in the transverse direction or in a diagonally posterior direction, and being continuous with the main portion; and at least one diagonal portion arranged anterior to the first flexible portions in the front-back direction of the foot and, extending from the main portion in a diagonally anterior direction toward the lateral side or in a diagonally anterior direction toward the medial side, and being continuous with the main portion, wherein:

the medial first flexible portion and the lateral first flexible portion are arranged along a virtual straight line extending across the main portion in the transverse direction or along a virtual forwardly-protruding curved line extending across the main portion; and the high rigidity region is adapted to cover another portion of the tips of the toes around the main portion, and is less stretchable and bendable than the low rigidity region, the high rigidity region comprising:

a peripheral portion continuous with the soles, and adapted to cover a periphery around the tips of the toes on the medial side of the foot, on the lateral side of the foot, and in a tip of the foot;

a medial posterior reinforcement portion being in contact with a posterior edge of the medial first flexible portion, being continuous with the peripheral portion, and adapted to cover a portion of the head of the first metatarsal bone;

a medial anterior reinforcement portion being in contact with an anterior edge of the medial first flexible portion, being continuous with the peripheral portion, extending from the peripheral portion toward the main portion, and adapted to cover a portion of the shaft of the first proximal phalanx;

a lateral posterior reinforcement portion being in contact with a posterior edge of the lateral first flexible portion, and being continuous with the peripheral portion;

a lateral anterior reinforcement portion being in contact with an anterior edge of the lateral first flexible portion, being continuous with the peripheral portion, and extending from the peripheral portion toward the main portion;

a portion provided on an anterior edge and a posterior edge of the diagonal portion and in contact with the anterior edge and the posterior edge of the diagonal portion;

the medial first flexible portion is sandwiched between the medial posterior reinforcement portion and the medial anterior reinforcement portion in the front-back direction of the foot; and the lateral first flexible portion is sandwiched between the lateral posterior reinforcement portion and the lateral anterior reinforcement portion in the front-back direction of the foot.

2. A structure according to claim 1, wherein:

the medial first flexible portion is adapted to extend to a position more on the medial side than a ridgeline of a big toe; and the diagonal portion is in contact with an anterior edge of the medial anterior reinforcement portion, and is adapted to extend to a position more on the medial side than the ridgeline of the big toe in a diagonally forward direction on the medial side of the foot from the main portion in an area posterior to a first interphalangeal joint.

3. A structure according to claim 1, wherein:

the medial first flexible portion is adapted to extend to a position more on the medial side than a ridgeline of a big toe; and the diagonal portion is adapted to extend from the main portion in a diagonally forward direction on the lateral side of the foot into an area of a distal phalanx of a second toe or a distal phalanx of a third toe or an area between the distal phalanges of the second toe and the third toe, in an area anterior to the lateral first flexible portion.

4. A structure according to claim 1, wherein:

the at least one diagonal portion is provided on the medial side and on the lateral side;

the diagonal portion on the medial side is in contact with an anterior edge of the medial anterior reinforcement portion, and is adapted to extend from the main portion in a diagonally forward direction on the medial side of the foot to a position more on the medial side than a ridgeline of a big toe, in an area posterior to a first interphalangeal joint;

the diagonal portion on the lateral side is adapted to extend from the main portion in a diagonally forward direction on the lateral side of the foot into an area of a distal phalanx of a second toe or a distal phalanx of a third toe or an area between the distal phalanges and of the second toe and the third toe, in an area anterior to the lateral first flexible portion; and an angle formed between a virtual line extending along a direction in which the diagonal portion on the lateral side extends and a virtual lateral line extending along the transverse direction is greater than an angle formed between a virtual line extending along a direction in which the diagonal portion on the medial side extends and the lateral line.

5. A structure according to claim 1, wherein:

a plurality of the at least one diagonal portions are provided on the lateral side;

one of the plurality of diagonal portions is in contact with an anterior edge of the lateral anterior reinforcement portion, and forms a lateral second flexible portion extending from the main portion in a diagonally forward direction on the lateral side of the foot;

another one of the plurality of diagonal portions forms a lateral third flexible portion adapted to extend from the main portion in a diagonally forward direction on the lateral side of the foot into an area of a distal phalanx of a second toe or a distal phalanx of a third toe or an area between the distal phalanges of the second toe and the third toe, in an area anterior to the lateral second flexible portion;

the lateral second flexible portion and the lateral third flexible portion are spaced apart from each other in the front-back direction with a portion of the high rigidity region interposed therebetween; and an angle formed between a virtual line extending along a direction in which the lateral third flexible portion extends and a virtual lateral line extending along the transverse direction is greater than an angle formed between a virtual line extending along a direction in which the lateral second flexible portion extends and the lateral line.

6. A structure according to claim 5, wherein:

the at least one diagonal portion includes a diagonal portion provided on the medial side;

the diagonal portion on the medial side forms a medial second flexible portion being in contact with an anterior edge of the medial anterior reinforcement portion, and adapted to extend to a position more on the medial side than a ridgeline of a big toe in a diagonally forward direction on the medial side of the foot from the main portion in an area posterior to a first interphalangeal joint; and the angle formed between the virtual line extending along the direction in which the lateral third flexible portion extends and the virtual lateral line extending along the transverse direction is greater than an angle formed between a virtual line extending along a direction in which the medial second flexible portion extends and the lateral line.

7. A structure according to claim 1, wherein:

a plurality of the at least one diagonal portions are provided on the medial side;

one of the plurality of diagonal portions forms a medial second flexible portion being in contact with an anterior edge of the medial anterior reinforcement portion, and adapted to extend from the main portion in a diagonally forward direction on the medial side of the foot to a position more on the medial side than a ridgeline of a big toe, in an area posterior to a first interphalangeal joint; and another one of the plurality of diagonal portions forms a medial third flexible portion extending from the main portion in a diagonally forward direction on the medial side of the foot, in an area anterior to the medial second flexible portion.

8. A structure according to claim 1, wherein:

the main portion is adapted to extend in a forward direction or a diagonally forward direction from a head of a second metatarsal bone to the shaft of the second proximal phalanx.

9. A structure according to claim 1, wherein the upper includes a tongue covering the instep, and the main portion is continuous with the tongue, with a width of the main portion in the transverse direction decreasing gradually in a forward direction.

10. A structure according to claim 1, wherein:

the peripheral portion of the high rigidity region is adapted to cover a medial side surface of a big toe in an area more on the medial side than the medial first flexible portion; and the peripheral portion of the high rigidity region is adapted to cover a lateral side surface of a little toe in an area more on the lateral side than the lateral first flexible portion.

11. A structure according to claim 1, wherein:

the lateral first flexible portion is adapted to extend from the main portion to a position more on the lateral side than a lateral edge of the third proximal phalanx.

12. A structure according to claim 1, wherein:

the medial and lateral first flexible portions have lengths in the transverse direction greater than widths thereof in the front-back direction.

13. A structure according to claim 1, wherein:

the second member includes a medial side edge portion adapted to cover a medial side surface of a big toe, a lateral side edge portion adapted to cover a lateral side surface of a little toe, and a plurality of protruding portions protruding from the medial side edge portion or the lateral side edge portion toward the main portion and being spaced apart from one another in the front-back direction; and the second member defines a depressed portion forming the diagonal portion between the plurality of protruding portions.

14. A structure according to claim 13, wherein:

the second member includes a ridge portion extending from the medial and lateral side edge portions to the protruding portions; and the ridge portion extends along an edge of the protruding portions.

15. A structure according to claim 13, wherein:

each of the protruding portions has a width in a width direction perpendicular to a direction in which the protruding portion extends, with the width of the protruding portion decreasing gradually toward the main portion; and the depressed portion has a width in a width direction perpendicular to a direction in which the depressed portion extends, with the width of the depressed portion increasing gradually toward the main portion.

16. A structure according to claim 1, wherein: the first member is formed by an air-permeable member that a plurality of through holes are provided with in the front-back and the transverse directions; and the second member is formed by a synthetic resin having a plurality of through holes allowing passage of air therethrough.

17. A structure according to claim 1, wherein:

the flexible portions and the diagonal portion each have a width in a width direction perpendicular to a direction in which the flexible portion or the diagonal portion extends, with the width increasing gradually toward the main portion.

18. A structure according to claim 1, wherein: the posterior edges of the medial and lateral first flexible portions each extend in a diagonally backward direction.

19. A structure according to claim 1, wherein: the medial first flexible portion is adapted to extend to a position more on the medial side than a ridgeline of a big toe.

20. A method of using a shoe, a structure for a front foot portion of an upper of the shoe comprising: soles adapted to support a foot sole; and the upper adapted to cover an instep, wherein:

the front foot portion of the upper includes a low rigidity region and a high rigidity region that has a rigidity higher than a rigidity of the low rigidity region;

the low rigidity region is formed by a first member that forms the upper, the first member including at least one of a mesh fabric, a knitted fabric, a woven fabric, a non-woven fabric, a synthetic leather, and a natural leather;

the high rigidity region is formed by the first member and a second member that is layered on a surface of the first member and is less stretchable than the first member; and the low rigidity region is adapted to cover a portion of tips of toes of a foot, and is more stretchable and bendable than the high rigidity region, the low rigidity region comprising:

a main portion extending in a front-back direction of the foot and in a transverse direction perpendicular to the front-back direction in a middle between a medial side and a lateral side of the front foot portion, and adapted to include a portion of an area from a shaft of a first proximal phalanx to a shaft of a second proximal phalanx;

a medial first flexible portion adapted to cover a portion of an area from the shaft of the first proximal phalanx to a head of a first metatarsal bone, extending toward the medial side of the foot from the main portion in the transverse direction or in a diagonally posterior direction, and being continuous with the main portion;

a lateral first flexible portion adapted to cover a portion of an area from a shaft to a base of a third proximal phalanx or a fourth proximal phalanx, extending toward the lateral side of the foot from the main portion in the transverse direction or in a diagonally posterior direction, and being continuous with the main portion; and at least one diagonal portion arranged anterior to the first flexible portions in the front-back direction of the foot and, extending from the main portion in a diagonally anterior direction toward the lateral side or in a diagonally anterior direction toward the medial side, and being continuous with the main portion, wherein:

the medial first flexible portion and the lateral first flexible portion are arranged along a virtual straight line extending across the main portion in the transverse direction or along a virtual forwardly-protruding curved line extending across the main portion; and the high rigidity region is adapted to cover another portion of the tips of the toes around the main portion, and is less stretchable and bendable than the low rigidity region, the high rigidity region comprising:

a peripheral portion continuous with the soles, and adapted to cover a periphery around the tips of the toes on the medial side of the foot, on the lateral side of the foot, and in a tip of the foot;

a medial posterior reinforcement portion being in contact with a posterior edge of the medial first flexible portion, being continuous with the peripheral portion, and adapted to cover a portion of the head of the first metatarsal bone;

a medial anterior reinforcement portion being in contact with an anterior edge of the medial first flexible portion, being continuous with the peripheral portion, extending from the peripheral portion toward the main portion, and adapted to cover a portion of the shaft of the first proximal phalanx;

a lateral posterior reinforcement portion being in contact with a posterior edge of the lateral first flexible portion, and being continuous with the peripheral portion;

a lateral anterior reinforcement portion being in contact with an anterior edge of the lateral first flexible portion, being continuous with the peripheral portion, and extending from the peripheral portion toward the main portion;

a portion provided on an anterior edge and a posterior edge of the diagonal portion and in contact with the anterior edge and the posterior edge of the diagonal portion;

the medial first flexible portion is sandwiched between the medial posterior reinforcement portion and the medial anterior reinforcement portion in the front-back direction of the foot; and the lateral first flexible portion is sandwiched between the lateral posterior reinforcement portion and the lateral anterior reinforcement portion in the front-back direction of the foot, the method comprising:

providing the shoe; and wearing the shoe, the wearing comprising:

adapting the main portion to include the portion of the area from the shaft of the first proximal phalanx to the shaft of the second proximal phalanx;

adapting the medial first flexible portion to cover the portion of the area from the shaft of the first proximal phalanx to the head of the first metatarsal bone;

adapting the lateral first flexible portion to cover the portion of the area from the shaft to the base of the third proximal phalanx or the fourth proximal phalanx;

adapting the medial posterior reinforcement portion to cover the portion of the head of the first metatarsal bone; and adapting the medial anterior reinforcement portion to cover the portion of the shaft of the first proximal phalanx.

* * * * *